US009563155B2

(12) United States Patent
Ishii et al.

(10) Patent No.: US 9,563,155 B2
(45) Date of Patent: Feb. 7, 2017

(54) COOLING DEVICE AND IMAGE FORMING APPARATUS INCORPORATING THE COOLING DEVICE

(71) Applicants: Kenji Ishii, Kanagawa (JP); Hiroaki Miyagawa, Kanagawa (JP); Tohru Matsumoto, Kanagawa (JP); Masahiro Yamazaki, Kanagawa (JP); Keisuke Kubota, Kanagawa (JP)

(72) Inventors: Kenji Ishii, Kanagawa (JP); Hiroaki Miyagawa, Kanagawa (JP); Tohru Matsumoto, Kanagawa (JP); Masahiro Yamazaki, Kanagawa (JP); Keisuke Kubota, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/807,379

(22) Filed: Jul. 23, 2015

(65) Prior Publication Data

US 2016/0026125 A1 Jan. 28, 2016

(30) Foreign Application Priority Data

Jul. 24, 2014 (JP) ..... 2014-150698
Aug. 19, 2014 (JP) ..... 2014-166498
(Continued)

(51) Int. Cl.
*G03G 15/20* (2006.01)
*G03G 21/20* (2006.01)

(52) U.S. Cl.
CPC ..... *G03G 15/2021* (2013.01); *G03G 15/2017* (2013.01); *G03G 21/206* (2013.01)

(58) Field of Classification Search
USPC ..... 399/341; 271/272
See application file for complete search history.

(56) References Cited

U.S. PATENT DOCUMENTS 8,447,220 B2 * 5/2013 Yamaguchi ..... G03G 15/2064 399/122
2009/0010691 A1 * 1/2009 Shiozawa ..... G03G 15/2039 399/341
(Continued)

FOREIGN PATENT DOCUMENTS

JP 2010-247955 11/2010
JP 2012-098677 5/2012

OTHER PUBLICATIONS

U.S. Appl. No. 14/610,121, filed Jan. 30, 2015.

*Primary Examiner* — Clayton E Laballe
*Assistant Examiner* — Warren K Fenwick
(74) *Attorney, Agent, or Firm* — Oblon, McClelland, Maier & Neustadt, L.L.P.

(57) ABSTRACT

A cooling device, which is includable to an image forming apparatus, includes a conveyor, a cooler, and at least one roller. The conveyor conveys a recording medium with a first roller and a second roller each of which is in a loop. The cooler is disposed within the loop of the second belt and cools the recording medium discharged from a fixing device. The at least one roller is a roller within the loop of the first belt and between a first end roller disposed at an end of the first belt facing a plane of a conveyance path. Alternatively, the at least one roller is multiple rollers within the loop of the first belt and contacts an inner circumferential surface of the first belt against the cooler and an upstream roller of the multiple rollers has a smallest pressing force of the multiple rollers.

19 Claims, 21 Drawing Sheets

(30) Foreign Application Priority Data

| | | |
|---|---|---|
| Aug. 25, 2014 | (JP) | 2014-170400 |
| Aug. 29, 2014 | (JP) | 2014-176014 |
| Jan. 19, 2015 | (JP) | 2015-007578 |

(56) References Cited

U.S. PATENT DOCUMENTS

| | | | | |
|---|---|---|---|---|
| 2013/0121739 | A1* | 5/2013 | Hatazaki | G03G 15/2021 399/341 |
| 2013/0170882 | A1* | 7/2013 | Shimada | G03G 8/00 399/341 |
| 2014/0186080 | A1 | 7/2014 | Ikeda et al. | 399/341 |
| 2014/0186081 | A1 | 7/2014 | Hirasawa et al. | 399/341 |
| 2014/0233996 | A1 | 8/2014 | Ikeda et al. | 399/341 |
| 2014/0270877 | A1 | 9/2014 | Tomino | 399/341 |
| 2014/0270878 | A1* | 9/2014 | Tomino | G03G 15/2021 399/341 |
| 2014/0308057 | A1* | 10/2014 | Tomino | G03G 15/2017 399/341 |
| 2014/0308058 | A1* | 10/2014 | Ikeda | G03G 15/6573 399/341 |
| 2014/0334858 | A1 | 11/2014 | Miyagawa et al. | 399/341 |
| 2015/0010338 | A1 | 1/2015 | Miyagawa et al. | 399/341 |
| 2015/0071677 | A1 | 3/2015 | Hirasawa et al. | 399/94 |
| 2015/0075207 | A1 | 3/2015 | Karikusa et al. | 62/380 |
| 2015/0160610 | A1* | 6/2015 | Watanabe | G03G 21/206 271/272 |
| 2015/0220030 | A1* | 8/2015 | Watanabe | B65H 1/04 399/341 |

* cited by examiner

COOLING DEVICE AND IMAGE FORMING APPARATUS INCORPORATING THE COOLING DEVICE

CROSS-REFERENCE TO RELATED APPLICATIONS

This patent application is based on and claims priority pursuant to 35 U.S.C. §119(a) to Japanese Patent Application Nos. 2014-150698, filed on Jul. 24, 2014, 2014-166498, filed on Aug. 19, 2014, 2014-170400, filed on Aug. 25, 2014, 2014-176014, filed on August 29, 2014, and 2015-007578, filed on Jan. 19, 2015, in the Japan Patent Office, the entire disclosure of each of which is hereby incorporated by reference herein.

BACKGROUND

Technical Field

This disclosure relates to a cooling device and an image forming apparatus incorporating the cooling device.

Related Art

Cooling devices include a cooler to absorb heat of a recording medium passing through a fixing device and cool the recording medium with the cooler while holding and conveying the recording medium between belts.

SUMMARY

At least one aspect of this disclosure provides a cooling device including a conveyor, a cooler, and a roller. The conveyor conveys a recording medium with a first belt and a second belt each of which is in a loop. The first belt is wound around a first end roller which is disposed at an end of the first belt facing a plane of a conveyance path. The cooler is disposed within the loop of the second belt and cools the recording medium discharged from a fixing device. The roller is disposed within the loop of the first belt and between the first end roller and the cooler. The roller contacts the first belt toward the conveyance path such that the conveyance path gradually widens along an upstream direction from a position where the roller contacts the first belt.

Further, at least one aspect of this disclosure provides an image forming apparatus including an image forming device to form an image on a recording medium and the above-described cooling device to cool the recording medium.

Further, at least one aspect of this disclosure provides a cooling device including a conveyor, a cooler, and rollers. The conveyor conveys a recording medium in a downstream direction with a first belt and a second belt each of which is in a loop. The cooler is disposed within the loop of the second belt and cools the recording medium discharged from a fixing device. The rollers are disposed within the loop of the first belt and contact an inner circumferential surface of the first belt against the cooler. An upstream roller of the rollers having a smallest pressing force of the rollers.

Further, at least one aspect of this disclosure provides an image forming apparatus including an image forming device to form an image on a recording medium and the above-described cooling device to cool the recording medium.

DETAILED DESCRIPTION

Figure 1:
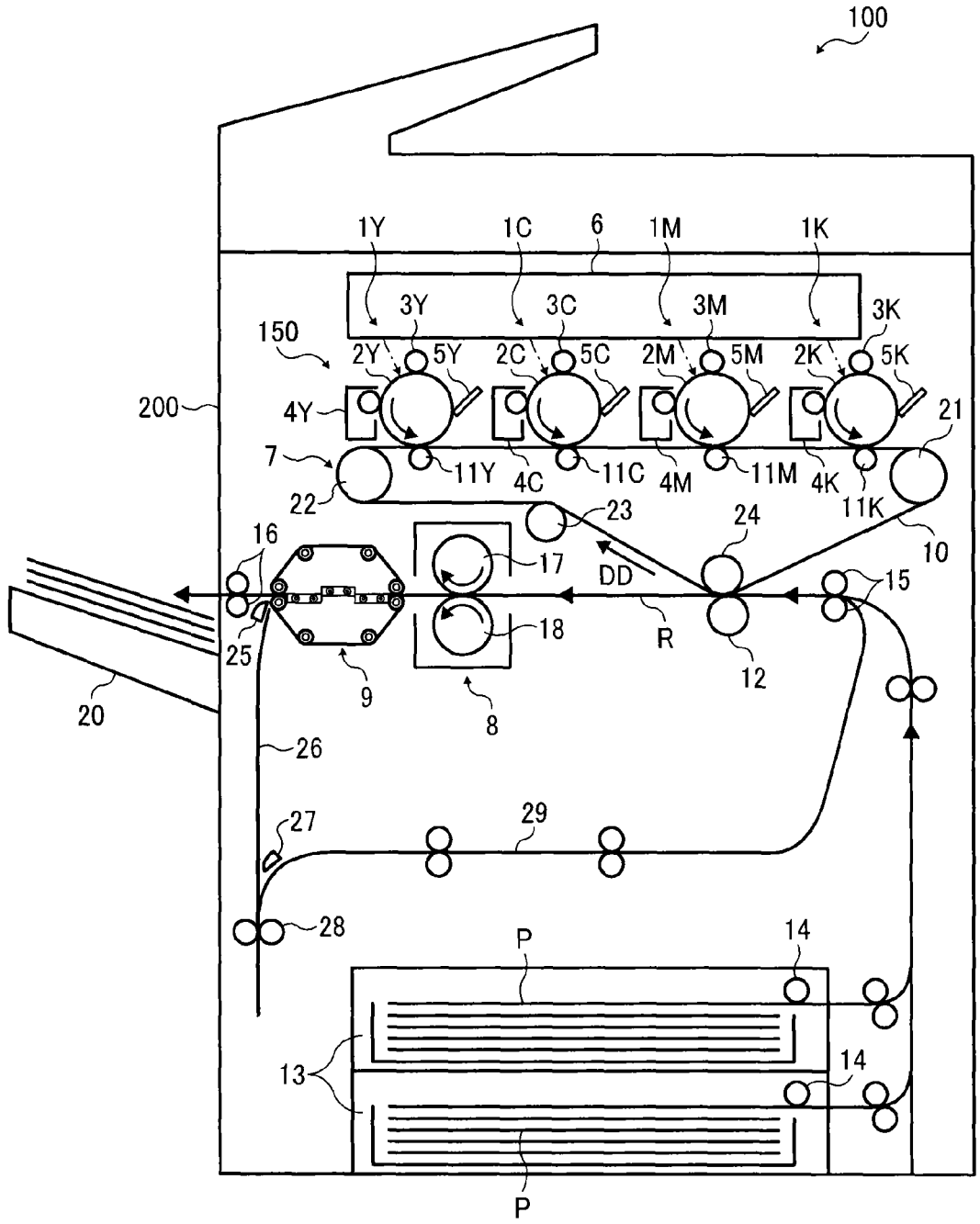
FIG. 1 illustrates a schematic configuration of a color image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an image forming apparatus 100 according to an example of this disclosure with reference to drawings.

The image forming apparatus 100 may be a copier, a printer, a scanner, a facsimile machine, a plotter, and a multifunction peripheral or a multifunction printer (MFP) having at least one of copying, printing, scanning, facsimile, and plotter functions, or the like.

According to the present example, the image forming apparatus 100 is an electrophotographic printer that forms toner images on a sheet or sheets by electrophotography.

Further, this disclosure is also applicable to image forming apparatuses adapted to form images through other schemes, such as known ink jet schemes, known toner projection schemes, or the like as well as to image forming apparatuses adapted to form images through electro-photographic schemes.

It is also to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, sheet member, and recording material to which the developer or ink is attracted.

A description is given of the color image forming apparatus 100 according to an example of this disclosure, with reference to FIG. 1. FIG. 1 is a schematic diagram illustrating the color image forming apparatus 100 according to an example of this disclosure.

As illustrated in FIG. 1, the image forming apparatus 100 has an apparatus body 200 that includes a tandem-type image forming part 150, an exposure device 6, a transfer device 7, and four primary transfer rollers 11Y, 11C, 11M, and 11K. The tandem-type image forming part 150 includes four process units 1Y, 1C, 1M, and 1K functioning as image forming units aligned in tandem. Suffixes, which are Y, C, M, and K, are used to indicate respective colors of toners (e.g., yellow, cyan, magenta, and black toners) for the process units. The process units 1Y, 1C, 1M, and 1K have substantially the same configuration except for containing different color toners of yellow (Y), cyan (C), magenta (M), and black (K) corresponding to color separation components of a color image.

The process units 1Y, 1C, 1M, and 1K are detachably attachable to the apparatus body 200 of the image forming apparatus 100.

The four process units 1Y, 1C, 1M, and 1K form respective single color toner images of yellow (Y), cyan (C), magenta (M), and black (K) on photoconductors 2Y, 2C, 2M, and 2K, respectively. The exposure device 6 is disposed above the process units 1Y, 1C, 1M, and 1K and exposes respective surfaces of the photoconductors 2Y, 2C, 2M, and 2K, respectively, to form respective electrostatic latent images thereon.

It is to be noted that FIG. 1 illustrates the four process units 1Y, 1C, 1M, and 1K having the identical configuration and functions to each other except toner colors, which are yellow (Y), magenta (M), cyan (C), and black (K). Each process unit 1 includes the photoconductor 2 (i.e., photoconductors 2Y, 2C, 2M, and 2K) and an image forming components disposed around the photoconductor 2 in a counterclockwise direction in the drawing. Specifically, the image forming components are a charging roller 3 (i.e., charging rollers 3Y, 3C, 3M, and 3K) that is disposed substantially upward from a rotation center of the photoconductor 2, a developing device 4 (i.e., developing devices 4Y, 4C, 4M, and 4K), and a photoconductor cleaning blade 5 (i.e., photoconductor cleaning blades 5Y, 5C, 5M, and 5K).

Specifically, the photoconductor 2 has a drum shape and functions as a latent image bearer. The charging roller 3 serves as a charger to charge a surface of the photoconductor 2. The developing device 4 forms a toner image on the surface of the photoconductor 2. The photoconductor cleaning blade 5 serves as a cleaner to clean the surface of the photoconductor 2.

In FIG. 1, the exposure device 6 is disposed above the respective surfaces of the process units 1Y, 1C, 1M, and 1K. The exposing device 6 includes, e.g., a light source, polygon mirrors, f-θ lenses, and reflection lenses to irradiate a laser beam onto the surface of the photoconductor 2.

The transfer device 7 is disposed below the process units 1Y, 1C, 1M, and 1K. The transfer device 7 includes an intermediate transfer belt 10 including an endless belt that functions as a transfer body. The intermediate transfer belt 10 is stretched over multiple of rollers 21 through 24 functioning as supports. One of the rollers 21 through 24 is rotated as a driving roller to circulate (rotate) the intermediate transfer belt 10 in a direction indicated by arrow DD in FIG. 1.

Four primary transfer rollers 11Y, 11C, 11M, and 11K functioning as primary transfer units are disposed at positions at which the primary transfer rollers 11Y, 11C, 11M, and 11K face the respective photoconductors 2Y, 2C, 2M, and 2K. At the respective positions, the primary transfer rollers 11Y, 11C, 11M, and 11K are pressed against an inner circumferential surface of the intermediate transfer belt 10. Thus, primary transfer nip regions are formed at positions at which the photoconductors 2Y, 2C, 2M, and 2K contact pressed portions of the intermediate transfer belt 10. Each of the primary transfer rollers 11Y, 11C, 11M, and 11K is connected to a power source, and a given direct current (DC) voltage and/or an alternating current (AC) voltage are supplied to the primary transfer rollers 11.

A secondary transfer roller 12 that functions as a second transfer unit is disposed at a position at which the secondary transfer roller 12 faces the roller 24 that is one of the rollers over which the intermediate transfer belt 10 is stretched. The secondary transfer roller 12 is pressed against an outer circumferential surface of the intermediate transfer belt 10. Thus, a secondary transfer nip region is formed at a position at which the secondary transfer roller 12 and the intermediate transfer belt 10 contact each other. Similar to the primary transfer rollers 11Y, 11C, 11M, and 11K, the secondary transfer roller 12 is connected to a power source, and a given direct current (DC) voltage and/or an alternating current (AC) voltage are supplied to the secondary transfer roller 12.

Multiple sheet trays 13 are disposed below the apparatus body 200 to accommodate sheet-type recording media P including a recording medium P, such as sheets of paper or overhead projector (OHP) sheets. Each sheet tray 13 is provided with a feed roller 14 to feed the recording media P stored therein. An output tray 20 that functions as a sheet output unit is mounted on an outer circumferential surface of the apparatus body 200 at the left side in FIG. 1 to stack the recording medium P discharged to an outside of the apparatus body 200.

The apparatus body 200 includes a recording medium conveyance path R to transport the recording medium P from the sheet trays 13 to the output tray 20 through the secondary transfer nip region. On the recording medium conveyance path R, a registration roller pair 15 are disposed upstream from the secondary transfer roller 12 in a transport direction of a recording medium P (hereinafter, recording media transport direction). A fixing device 8, a cooling device 9, and an output roller pair unit 16 are disposed in turn at positions downstream from the secondary transfer roller 12 in the recording media transport direction. The fixing device 8 includes a fixing roller 17 and a pressure roller 18. The fixing roller 17 functions as a fixing member including an internal heater (a heat source). The pressure roller 18 that functions as a pressing member to press the fixing roller 17. A fixing nip region is formed at a position at which the fixing roller 17 and the pressure roller 18 contact each other.

Next, a description is given of a basic operation of the image forming apparatus 100 with reference to FIG. 1.

It is to be noted that the components and units having the identical configuration or structure except for toner color are occasionally described without suffixes. For example, the photoconductors 2Y, 2C, 2M, and 2K are hereinafter also referred to in a singular form as the photoconductor 2.

When imaging operation is started, the photoconductor 2 (i.e., the photoconductors 2Y, 2C, 2M, and 2K) of the process unit 1 (i.e., the process units 1Y, 1C, 1M, and 1K) is rotated counterclockwise in FIG. 1, and the charging roller 3 (i.e., the charging rollers 3Y, 3C, 3M, and 3K) uniformly charges the surface of the photoconductor 2 with a given polarity. Based on image information of a document read by a reading device, the exposing device 6 irradiates laser light onto the charged surface of the photoconductor 2 to form an electrostatic latent image on the surface of the photoconductor 2. At this time, image information exposed to each photoconductor 2 is single-color image information obtained by separating a desired full-color image into single-color information on yellow, cyan, magenta, and black. The developing device 4 (i.e., the developing devices 4Y, 4C, 4M, and 4K) supplies toner onto the electrostatic latent image formed on the photoconductor 2, thus making the electrostatic latent images a visible image as a toner image.

One of the rollers 21 to 24 over which the intermediate transfer belt 10 is stretched is driven for rotation to circulate the intermediate transfer belt 10 in the direction indicated by arrow DD in FIG. 1. A voltage having a polarity opposite a charged polarity of toner and subjected to constant voltage or current control is supplied to the primary transfer roller 11 (i.e., the primary transfer roller 11Y, 11C, 11M, and 11B). As a result, a transfer electric field is formed at the primary transfer nip region between each primary transfer roller 11 and the opposing photoconductor 2. Toner images of respective colors on the photoconductors 2 are transferred one on another onto the intermediate transfer belt 10 by the transfer electric fields formed at the primary transfer nip regions. Thus, the intermediate transfer belt 10 bears a full-color toner image on the surface of the intermediate transfer belt 10. Residual toner remaining on each photoconductor 2 without being transferred onto the intermediate transfer belt 10 is removed with the cleaning blade 5.

With rotation of the feed roller 14, the recording medium P is fed from the corresponding sheet tray 13. The recording medium P is further sent to the secondary transfer nip region between the secondary transfer roller 12 and the intermediate transfer belt 10 by the registration roller pair 15 so as to synchronize with the full-color toner image on the intermediate transfer belt 10. At this time, a transfer voltage of the polarity opposite the charged polarity of toner of the toner image on the intermediate transfer belt 10 is supplied to the secondary transfer roller 12. As a result, a transfer electric field is formed at the secondary transfer nip region. By the transfer electric field formed at the secondary transfer nip region, the toner image on the intermediate transfer belt 10 is collectively transferred onto the recording medium P. Then, the recording medium P is sent into the fixing device 8, and the fixing roller 17 and the pressure roller 18 apply heat and pressure to fix the toner image on the recording medium P. After the recording medium P is cooled with the cooling device 9, the output roller pair unit 16 output the recording medium P onto the output tray 20.

When performing duplex printing, the cooled recording medium P is firstly guided to a reversing path 26 by switching a separation claw 25. Then, a separation claw 27 is switched and a roller 28 is rotated in a reverse direction, so that the reversed recording medium P is to the registration roller pair 15 via a reversing path 29. Thus, the recording medium P is reversed. At this time, a toner image that is an image to be printed on a back face of the recording medium P is formed on the intermediate transfer belt 10. After being transferred onto the back face of the recording medium P, this toner image is fixed to the recording medium P by the fixing device 8 and the recording medium P is cooled by the cooling device 9. Then, the recording medium P is conveyed by the output roller pair unit 16 onto the output tray 20.

The above description relates to image forming operation for forming a full color image on the recording medium. In other image forming operation, a single color image can be formed by any one of the process units 1Y, 1C, 1M, and 1K, or a composite color image of two or three colors can be formed by two or three of the process units 1Y, 1C, 1M, and 1K.

Figure 2:
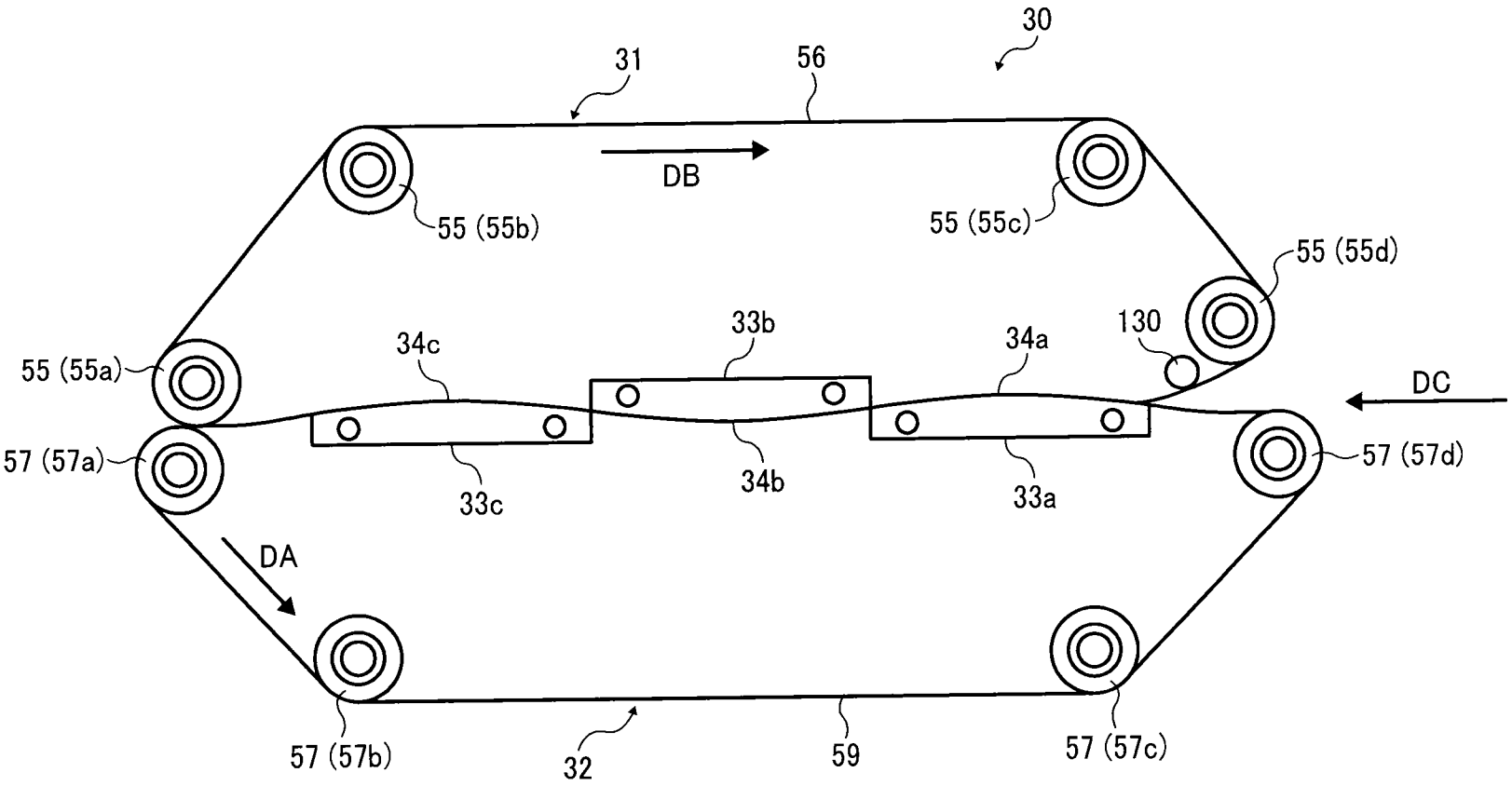
FIG. 2 is an enlarged view of a cooling device included in the image forming apparatus of FIG. 1.

Now, FIG. 2 is a schematic diagram illustrating the cooling device 9 according to an example of this disclosure.

As illustrated in FIG. 2, the cooling device 9 that functions as a recording medium conveyor has cooling members 33*a*, 33*b*, and 33*c*, each functioning as a cooler to cool the recording medium P conveyed by traveling of belts of a belt conveyance unit 30. The belt conveyance unit 30 includes a first conveyance assembly 31 and a second conveyance assembly 32. The first conveyance assembly 31 is disposed at a side of a first face (front face or upper face) of the recording medium P. The second conveyance assembly 32 is disposed at a side of a second face (back face or lower face) of the recording medium P. Each of the first conveyance assembly 31 and the second conveyance assembly 32 has at least one of the cooling members 33*a*, 33*b*, and 33*c*. The cooling member (liquid cooling plate) 33*a* functions as a first cooling unit that is a pressing-member-side cooling unit disposed at the side of the second face (back face or lower face) of the recording medium P. The cooling member 33*b* functions as a second cooling unit that is a fixing-member-side cooling unit disposed at the side of the first face (front face or upper face) of the recording medium P. The cooling member 33*c* functions as a third cooling unit that is a pressing-member-side cooling unit disposed at the side of the second face (back face or lower face) of the recording medium P.

The cooling members 33*a*, 33*b*, and 33*c* are disposed offset in a sheet conveying direction of the recording medium P. The cooling member 33*b* disposed at the side of the first face has, as a lower surface, a heat absorbing surface 34*b* of an arc surface shape protruding downward. The cooling members 33*a* and 33*c* at the side of the second face have, as upper surfaces, heat absorbing surfaces 34*a* and 34*c* of an arc surface shape protruding upward. Each of the cooling members 33*a*, 33*b*, and 33*c* includes a cooling-liquid channel through which cooling liquid flows.

Figure 3:
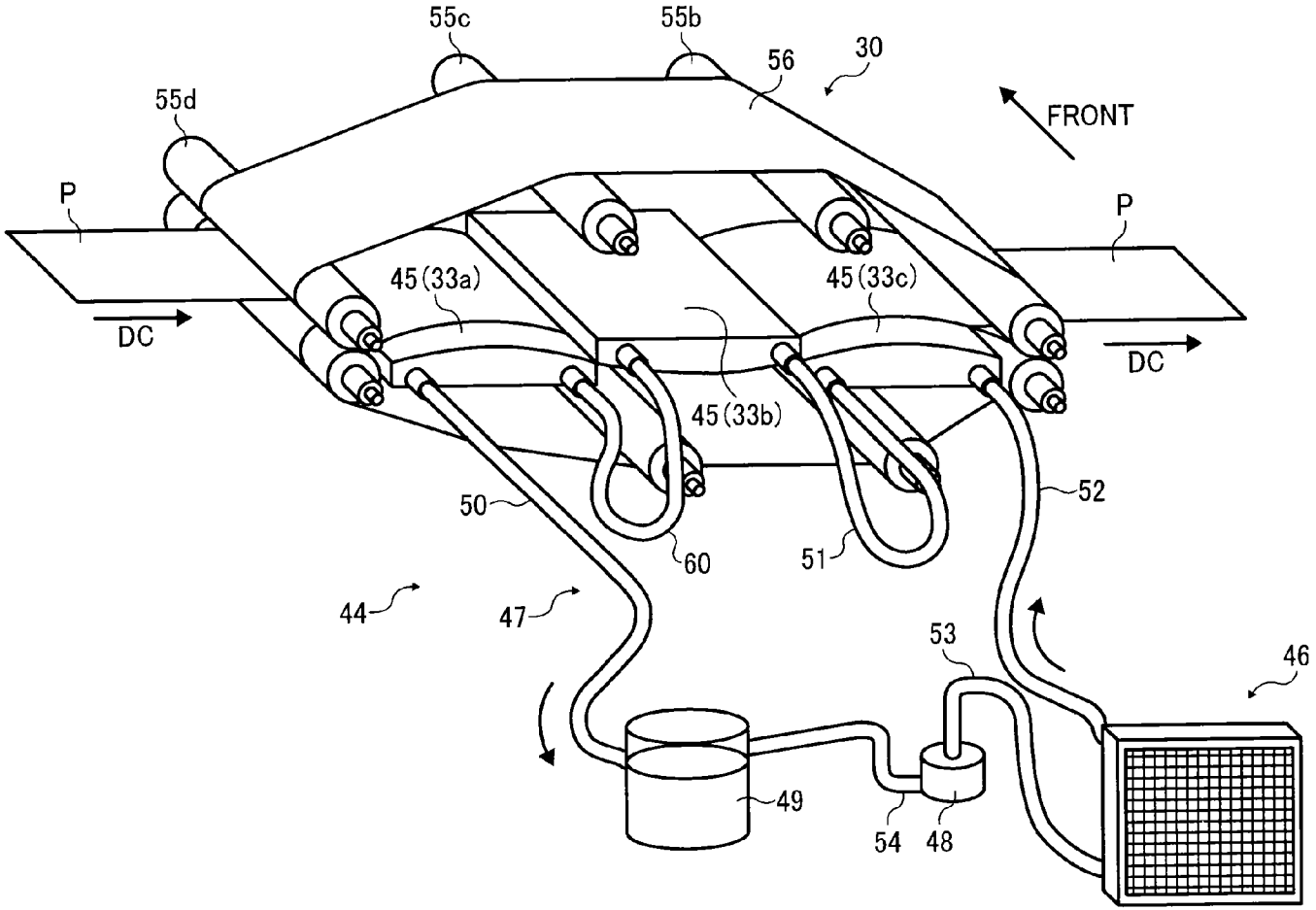
FIG. 3 illustrates a rear side of the cooling device of FIG. 2.

In other words, as illustrated in FIG. 3, the cooling device 9 has a cooling-liquid circuit 44. FIG. 3 is a schematic diagram illustrating a rear side of the cooling device 9 of FIG. 2. The cooling-liquid circuit 44 includes a heat receiving part 45 to receive heat from the recording medium P that functions as a heat generating part, a heat dissipating part 46 to radiate heat of the heat receiving part 45, and a circulation channel 47 to circulate cooling liquid through the heat receiving part 45 and the heat dissipating part 46. The circulation channel 47 includes a pump 48 to circulate cooling liquid and a liquid tank 49 to store cooling liquid. Each of the cooling members 33*a*, 33*b*, and 33*c*, which are, e.g., liquid cooling plates, functions as the heat receiving part 45. The heat dissipating part 46 includes, e.g., a radiator. The cooling liquid is, for example, a liquid that contains water as main component and an antifreeze (e.g., propylene glycol or ethylene glycol) to reduce the freezing point, and an antirust (e.g., phosphate medium Phosphoric acid potassium salt, or inorganic potassium salt) as additives.

The circulation channel 47 includes pipes 50, 60, 51, 52, 53, and 54. The pipe 50 connects a first opening of the cooling member 33*a* to the liquid tank 49. The pipe 60 connects a second opening of the cooling member 33*a* to a first opening of the cooling member 33*b*. The pipe 51 connects a second opening of the cooling member 33*b* to a first opening of the cooling member 33*c*. The pipe 52 connects a second opening of the cooling member 33*c* to the heat dissipating part 46 (e.g., radiator). The pipe 53 connects the heat dissipating part 46 to the pump 48. The pipe 54 connects the pump 48 to the liquid tank 49. The circulation channel 47 including the pipes 50, 60, 51, 52, 53, and 54 forms a single channel. However, the circulation channel 47 meanders in the cooling members 33*a*, 33*b*, and 33*c*, thus allowing cooling liquid to effectively cool the cooling members 33*a*, 33*b*, and 33*c*.

The first conveyance assembly 31 includes multiple rollers (driven rollers) 55 (e.g., four rollers 55*a*, 55*b*, 55*c*, and 55*d* in FIG. 2) and a belt (a conveyance belt) 56. The belt 56 that functions as a first belt or a second belt is wound around the multiple rollers 55. Each roller of the multiple rollers 55*a*, 55*b*, 55*c*, and 55*d* functions as a rotator and a tensioner to tension the belt 56.

The second conveyance assembly 32 includes multiple rollers (a driving roller 57*a* and driven rollers 57*b*, 57*c*, and 57*d* in FIG. 2), and a belt (a conveyance belt) 59. The belt 59 that functions as a second belt or a first belt is wound around the driving roller 57*a* and the multiple rollers 57*b*, 57*c*, and 57*d*. Each roller of the driving roller 57*a* and the multiple rollers 57*b*, 57*c*, and 57*d* is a rotator and a tensioner to tension the belt 59.

Accordingly, the recording medium P is held between and conveyed by the belt 56 of the first conveyance assembly 31 and the belt 59 of the second conveyance assembly 32 disposed facing the first conveyance assembly 31. In other words, as illustrated in FIG. 2, the belt 59 is traveled in a direction indicated by arrow DA (hereinafter, referred to as a direction DA) by driving of the driving roller 57*a*. Along with travel of the belt 59, the belt 56 of the first conveyance assembly 31 is traveled in a direction indicated by arrow DB (hereinafter, referred to as a direction DB) via the recording medium P held between the belts 56 and 59. Thus, the recording medium P is conveyed from an upstream side to a downstream side in a direction indicated by arrow DC in FIG. 2 (hereinafter, referred to as a direction DC).

Next, a description is given of operation of the recording medium cooling device 9 having the above-described configuration.

When the recording medium P is held and conveyed by the belts 56 and 59, as illustrated in, e.g., FIG. 2, the first conveyance assembly 31 and the second conveyance assembly 32 are placed adjacent to each other. In a state illustrated in FIG. 2, if the driving roller 57*a* of the second conveyance assembly 32 is rotated, as described above, the belts 56 and 59 travel in the directions DA and DB, respectively, to convey the recording medium P in the direction DC. In such a state, cooling liquid is circulated in the cooling-liquid circuit 44. In other words, the pump 48 is activated to flow the cooling liquid through the cooling liquid channels of the cooling members 33*a*, 33*b*, and 33*c*.

At this time, an inner circumferential surface of the belt 56 of the first conveyance assembly 31 slides over the heat absorbing surface 34*b* of the cooling member 33*b* and an inner circumferential surface of the belt 59 of the second conveyance assembly 32 slides over the heat absorbing surface 34*a* of the cooling member 33*a* and the heat absorbing surface 34*c* of the cooling member 33*c*. From a front face (upper face) side of the recording medium P, the cooling member 33*b* absorbs heat of the recording medium P via the belt 56. From a back face (lower face) side of the recording medium P, the cooling members 33*a* and 33*c* absorb heat of the recording medium P via the belt 59. In such a case, an amount of heat absorbed by the cooling members 33*a*, 33*b*, and 33*c* is transported to the outside by the cooling liquid, thus maintaining the cooling members 33*a*, 33*b*, and 33*c* at relatively low temperatures.

Specifically, by driving the pump 48, the cooling liquid is circulated through the cooling-liquid circuit 44. The cooling liquid flows through the cooling-liquid channels of the cooling members 33*a*, 33*b*, and 33*c*, absorbs heat of the cooling members 33*a* and 33*b*, and turns into a relatively high temperature. The cooling liquid at high temperature passes through the heat dissipating part 46 (e.g., radiator), and heat of the cooling liquid is radiated to outside air, thus reducing the temperature of the cooling liquid. The cooling liquid at relatively low temperature flows through the cooling-liquid channels again, and the cooling members 33*a*, 33*b*, and 33*c* act as the heat dissipating part 46. By repeating the above-described cycle, the recording medium P is cooled from both sides thereof.

It is to be noted that this disclosure is not limited to the cooling device in which the cooling liquid is circulated therein. For example, a cooling device including heat sinks is also applicable to this disclosure.

Material of the belts 56 and 59 as illustrated in FIG. 2 is thin film resin such as polyimide.

Here, the belt 56 and the belt 59 have outer circumferential surfaces having different surface roughnesses. For example, an arithmetic mean roughness (Ra) of the outer circumferential surface of the belt 56 facing the first face of the recording medium P and contacting the recording medium P is at least 0.4 μm. The outer circumferential surface of the belt 56 is processed to have the value of 0.4 μm or greater. By contrast, an arithmetic mean roughness (Ra) of the outer circumferential surface of the belt 59 facing the second face of the recording medium P and contacting the recording medium P is substantially 0.1 μm. Therefore, the surface of the belt 56 is relatively rough and the surface of the belt 59 is relatively smooth.

In a comparative configuration, when a recording medium that has been output from a fixing device passes the cooling device to be cooled, gloss nonuniformity is likely to cause depending on types of recording media. Compared with the comparative configuration, the belts 56 and 59 described in the example can reduce or prevent gloss nonuniformity. It is thought that the gloss nonuniformity is prevented because, if the belt 56 that contacts the first face of the recording medium P having a toner image thereon has a smooth surface, toner is immediately cooled, but if the belt 56 has a rough surface and less contact areas than the smooth surface, toner is cooled more slowly.

Table 1 shows test results of confirmation of gloss nonuniformity of the recording medium P. Here, gloss nonuniformity is confirmed when the arithmetic mean roughness (Ra) of the outer circumferential surface of the belt 59 is 0.1 μm and the arithmetic mean roughness (Ra) of the outer circumferential surface of the belt 56 is varied. In a column of Gloss Nonuniformity on Surface of Recording Medium P, "Poor" represents a level that gloss nonuniformity is confirmed visually, "Acceptable" represents a level that gloss nonuniformity is confirmed visually and has no big influence on quality, and "Good" represents a level that gloss nonuniformity is not confirmed visually.

TABLE 1

| Ra (μm) | | Gloss Nonuniformity on Surface of Recording |
|---|---|---|
| Belt 56 | Belt 59 | Medium P |
| 0.3 | 0.1 | Poor |
| 0.4 | 0.1 | Acceptable |
| 1.0 | 0.1 | Acceptable |
| 1.2 | 0.1 | Acceptable |
| 1.3 | 0.1 | Acceptable |
| 1.5 | 0.1 | Acceptable |
| 1.6 | 0.1 | Good |
| 1.7 | 0.1 | Good |
| 1.8 | 0.1 | Good |
| 1.9 | 0.1 | Good |
| 2.0 | 0.1 | Good |
| 2.1 | 0.1 | Good |
| 2.2 | 0.1 | Good |
| 3.2 | 0.1 | Acceptable |
| 3.3 | 0.1 | Poor |

Recording Medium Used: Coated Paper (Material: Stearing Gross).

Fixing Temperature: 170 degrees Celsius.

From the test results shown in Table 1, it was found that, by setting the arithmetic mean roughness (Ra) of the outer circumferential surface of the belt 56 in a range of from 0.4 μm to 3.2 μm, preferably in a range of from 1.6 μm to 2.2 μm, occurrence of gloss nonuniformity of the surface of the recording medium can be prevented.

Further, the number of the cooling members is not limited to the configurations illustrated in FIGS. 1 through 3. For example, a single cooling member can be applied to this disclosure.

Further, the cooling member disposed at the extreme upstream side in the recording medium conveying direction is not limited to be arranged on the lower side belt (i.e., the belt 59). For example, the extreme upstream cooling member can be arranged on the upper side belt (i.e., the belt 56). In this case, the tension member is located to the lower side belt. Further, the shape of the absorbing surface of the cooling member is not limited to an arc surface shape. For example, the absorbing surface of the cooling member can be a flat surface.

Further, when the positions of the intermediate transfer belt 10 and the secondary transfer roller 12 are vertically switched (i.e., the first image forming operation is performed with respect to the back face of the recording medium P), the surface of the belt 59 is preferably made as rough as the surface of the belt 56 as shown in Table 1.

Further, in Table 1, the surface roughness of the belt 56 is changed while the surface roughness of the belt 59 is constant and smooth. However, the conditions of the surface roughness of the belts 56 and 59 are not limited thereto. For example, if the image forming apparatus 100 performs image formation on the back face of the recording medium P used in Table 1, the arithmetic mean roughness (Ra) of the surface of the belt 59 is set to be identical to the arithmetic mean roughness (Ra) of the surface of the belt 56 shown in Table 1 in order to reduce gloss nonuniformity on the back face of the recording medium P.

Table 2 shows test results of confirmation of gloss nonuniformity of the recording medium P. Similar to the test results shown in Table 1, it was found from the test results shown in Table 2 that, by setting the arithmetic mean roughness (Ra) of the outer circumferential surface of the belt 59 in a range of from 0.4 μm to 3.2 μm, preferably in a range of from 1.6 μm to 2.2 μm, occurrence of gloss nonuniformity of the surface of the recording medium can be prevented. It is to be noted that, even not indicated in Table 2, if the recording medium P passes through the fixing device 8 after a toner image is formed on the back face thereof, the solidified toner image on the front face of the recording medium P changes to a half melted state. However, the surface of the belt 56 facing the front face of the recording medium is rough, gloss nonuniformity on the front face of the recording medium P that has been reentered to the cooling device 9 can be reduced. In addition, by providing the identical roughness (Ra) to the belts 56 and 59, the material of the belts 56 and 59 is also the same, and therefore a reduction in cost can be achieved.

TABLE 2

| Ra (μm) | | Gloss Nonuniformity on Surface of Recording |
|---|---|---|
| Belt 56 | Belt 59 | Medium P |
| 0.3 | 0.3 | Poor |
| 0.4 | 0.4 | Acceptable |
| 1.0 | 1.0 | Acceptable |
| 1.2 | 1.2 | Acceptable |
| 1.3 | 1.3 | Acceptable |
| 1.5 | 1.5 | Acceptable |
| 1.6 | 1.6 | Good |
| 1.7 | 1.7 | Good |
| 1.8 | 1.8 | Good |
| 1.9 | 1.9 | Good |
| 2.0 | 2.0 | Good |
| 2.1 | 2.1 | Good |
| 2.2 | 2.2 | Good |
| 3.2 | 3.2 | Acceptable |
| 3.3 | 3.3 | Poor |

Figure 4:
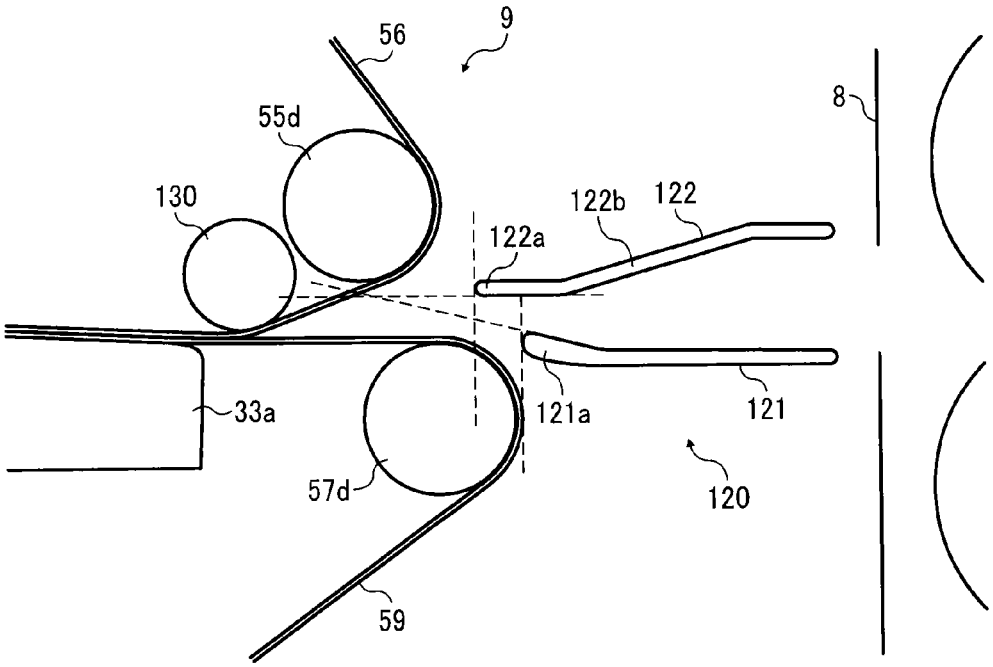
FIG. 4 is a side view of the cooling device, a fixing device, and a guide according to an example of this disclosure.

FIG. 4 is a side view of the cooling device 9, the fixing device 8, and a guide 120 according to an example of this disclosure.

The image forming apparatus 100 uses various types of recording media P, which are from a thin paper to a thick paper. Further, the grain direction of the recording medium P may be parallel to or across the recording medium conveying direction. Therefore, depending on the type, the recording medium P heated at a high temperature in the fixing device 8 may curl upward or downward after passing the fixing device 8. When the recording medium P is curled, if the roller 55*d* and the roller 57*d* shown in FIG. 2 are disposed in contact with each other, it is difficult to convey the curled leading edge of the recording medium P to a nip formed between the roller 55*d* and the roller 57*d*.

As illustrated in FIG. 4, the cooling device 9 includes a tension member 130 that is disposed between the roller 55*d* and the cooling member 33*a* in the moving direction of the belt 56. The tension member 130 extends the recording medium conveyance path R from the downstream side toward the upstream side in the recording medium conveying direction.

Here, the roller 55*d*, which functions as a first rotator, rotates while extending the belt 56 at a position upstream from the cooling member 33*a* in the belt moving direction and is separated from the roller 57*d*. The roller 55*d* is also disposed on the extreme upstream side in the recording medium conveying direction in the first conveyance assembly 31. With this condition, the leading edge of the recording medium P that is ejected from the fixing device 8 can enter between the belts 56 and 59 of the cooling device 9 reliably.

Further, as illustrated in FIG. 4, the tension member 130 is disposed such that the belts 56 and 59 contact at a position upstream from the contact area of the cooling member 33*a* and the belt 59 in the second belt moving direction. With this configuration, the recording medium P is held between the belts 56 and 59 before entering the absorbing surface of the cooling member 33*a*. Therefore, the recording medium P can be cooled efficiently.

Further, as illustrated in FIG. 4, the roller 57*d*, which functions as a second rotator, rotates while extending the belt 59 at a position upstream from the cooling member 33*a* in the second belt moving direction. The roller 57*d* is also disposed on the extreme upstream side in the recording medium conveying direction in the second conveyance assembly 32. In addition, the guide 120 is disposed to guide the recording medium P to the recording medium conveyance path R between the roller 57*d* and the roller 55*d*. The guide 120 guides the recording medium P ejected from the fixing device 8 to the cooling device 9 and includes an upper guide member 122 and a lower guide member 121.

The upper guide member 122 is disposed such that a tangent illustrated in a dotted line in FIG. 4 extending from a bottom face of an edge 122*a* of the upper guide member 122 in the recording medium conveying direction passes between the tension member 130 and the roller 55*d*. The edge 122*a* extends closer to the cooling device 9 than an edge 121*a* of the lower guide member 121 and above the roller 57*d*.

The edge 121 a of the lower guide member 121 in the recording medium conveying direction tilts in an upstream direction. The lower guide member 121 is disposed such that a tangent illustrated in another dotted line in FIG. 4 extending from a top face of the edge 121*a* of the lower guide member 121 passes between the tension member 130 and the roller 55*d*. The edge 121*a* of the lower guide member 121 is disposed at a position right above a right end of the roller 57*d* corresponding to an upstream end of the second conveyance assembly 32 in the recording medium conveying direction. An upper end of the edge 121 a is substantially flush with the surface of the belt 59 that is stretched between the cooling member 33*a* and the roller 57*d*. By contrast, a lower end of the edge 121*a* is lower than the upper surface of the belt 59 between the roller 57*d* and the cooling member 33*a* and higher than the center of the roller 57*d*.

With this configuration, even if the leading edge of the recording medium is curled downwardly, the leading edge of the recording medium is guided upwardly due to the inclination of the edge 121 a, thereby preventing the leading edge of the recording medium from falling into a gap between the roller 57*d* and the edge 121*a*. In the present example, the upper guide member 122 and the lower guide member 121 are disposed away from the fixing device 8 individually. However, the respective right ends of the upper guide member 122 and the lower guide member 121 may be integrally formed with the housing of the fixing device 8.

The edge 122*a* of the upper guide member 122 in the recording medium conveying direction is located downstream from the upstream end of the second conveyance assembly 32 in the recording medium conveying direction. The edge 122*a* also extends in a substantially horizontal direction, which is a direction toward the belt 56 of the first conveyance assembly 31. Specifically, the edge 122*a* is disposed such that a tangent extending from the edge 122*a* intersects with the surface of the belt 56 ranging between the roller 55*d* and the tension member 130. Further, a slope 122*b* that inclines from the upper side to the lower side is provided upstream from the edge 122*a* in the recording medium conveying direction. Therefore, even if the leading edge of the recording medium is curled upwardly, the leading edge of the recording medium is guided downwardly or corrected due to the inclination of the slope 122*b*, and therefore is guided to the edge 122*a*. In addition, even if the leading edge of the recording medium that has passed the edge 122*a* is curled upwardly, the recording medium contacts the belt 56 without entering between the edge 122*a* and the roller 55*d*.

According to this configuration, even if the recording medium P after passing through the fixing device 8 is curled, the recording medium P is held between the belts 56 and 59 to enter the absorbing surface of the cooling member 33*a*.

Figure 5:
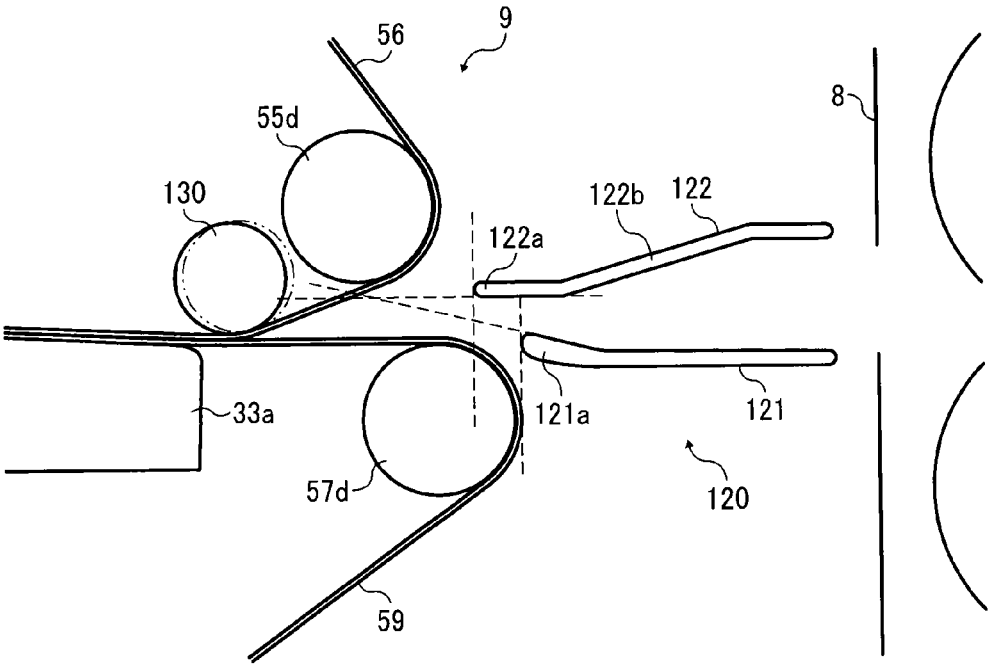
FIG. 5 is a side view of a cooling device, a fixing device, and a guide according to another example of this disclosure.
Figure 6:
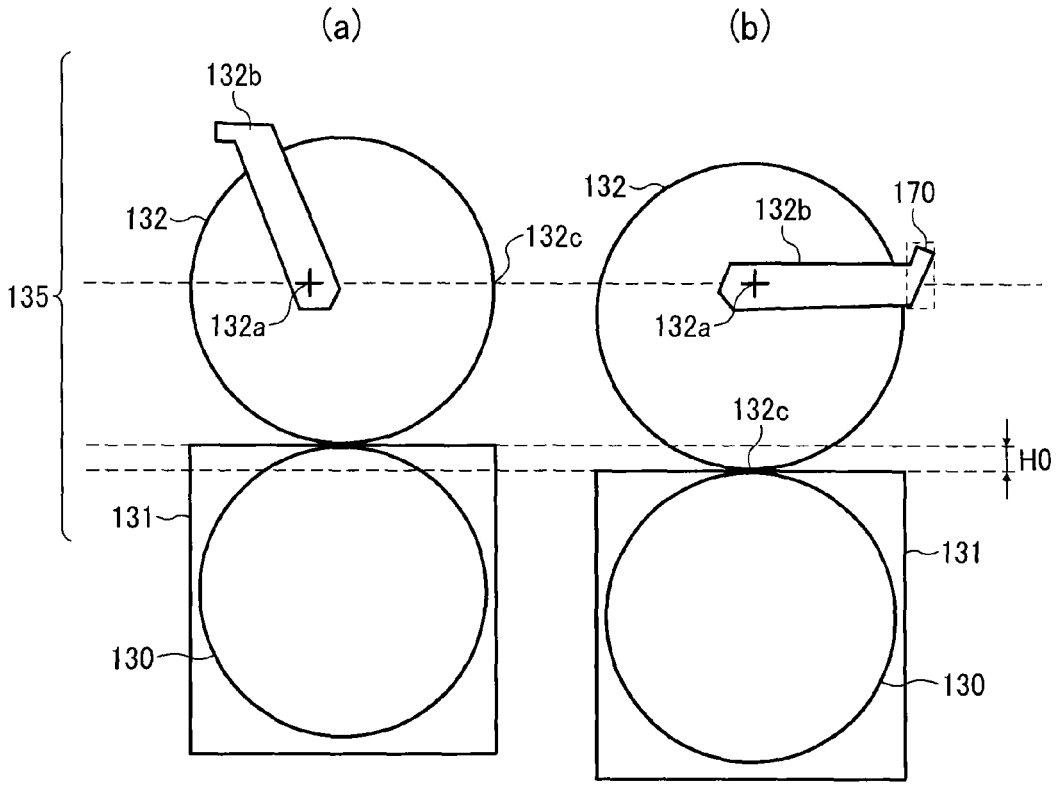
FIG. 6 is a side view of an eccentric cam unit that presses a tension member.

Next, a description is given of the cooling device 9 according to an example of this disclosure, with reference to FIGS. 5 and 6.

FIG. 5 is a side view of the cooling device 9, the fixing device 8, and the guide 120 according to another example of this disclosure. FIG. 6 is a side view of an eccentric cam unit 135 that presses the tension member 130.

The tension member 130 in FIGS. 5 and 6 is different from the tension member 130 in FIG. 4. Specifically, the tension member 130 in FIGS. 5 and 6 is fixedly disposed and can move to change the recording medium holding region of the belts 56 and 59 in the recording medium conveying direction. The tension member 130 before moving is depicted with a dotted line, which is located at the same position as the tension member 130 in FIG. 4. By contrast, the tension member 130 after moving is illustrated with a solid line. As illustrated in FIG. 5, the tension member 130 is moved downwardly, and therefore a contact area of the belts 56 and 59 along the recording medium conveying direction is greater than a contact area of the belts 56 and 59 along the recording medium direction in FIG. 4. Therefore, a distance between a contact start point of the contact area of the belts 56 and 59 and the fixing nip of the fixing device 8 in FIG. 5 is shorter than a distance between a contact start point of the belts 56 and 59 and the fixing nip of the fixing device 8 in FIG. 4. Further, in FIG. 5, an angle of the belt 59 and the belt 56 that widens from the downstream side to the upstream side in the recording medium conveying direction is greater than an angle of the belt 59 and the belt 56 in FIG. 4.

As previously described, FIG. 6 is a side view of the eccentric cam unit 135 that presses the tension member 130.

As illustrated in FIG. 6, a holder 131 is disposed at both axial ends of the tension member 130 to support the tension member 130. A camshaft 132 is disposed above each holder 131. A rotation center 132*a* of the camshaft 132 is eccentric and the camshaft 132 rotates about the center 132*a*. A lever 132*b* is disposed outside an axial end face of the camshaft 132. The lever 132*b* is connected to the rotation center 132*a* to rotate the camshaft 132. As a user manually rotates the lever 132*b* located at the position illustrated in a diagram (a) of FIG. 6 to the position illustrated in a diagram (b) of FIG. 6 in a clockwise direction, a point 132*c* on the camshaft 132 located at the right end on the diagram (a) of FIG. 6 moves to the bottom end on the diagram (b) of FIG. 6. Along with this movement, the holder 131 and the tension member 130 supported by the holder 131 is moved down by a distance HO from the position illustrated in the diagram (a) of FIG. 6 to the position illustrated in the diagram (b) of FIG. 6. Therefore, the contact area of the belts 56 and 59 is greater in the diagram (b) of FIG. 6 than in the diagram (a) of FIG. 6.

The distance H0 is 1 mm to 2 mm in the present example, the value is not limited thereto and varies depending on respective cooling devices 9. The tension member 130 is rotated with the belt 56. By contrast, the camshaft 132 contacts the fixed holder 131 alone, and therefore is not rotated with the belt 56.

Therefore, when the length in the recording medium conveying direction of the minimum-size recording medium that can be used in the image forming apparatus 100 is shorter than a distance from the fixing nip of the fixing device 8 to the extreme upstream point of the contact area of the belts 56 and 59 of the cooling device 9, the distance from the fixing nip of the fixing device 8 to the extreme upstream contact point of the cooling device 9 can be reduced by pressing down the camshaft 132 as illustrated in the diagram (b) of FIG. 6. As a result, the recording medium can be conveyed reliably regardless of the length thereof.

Figure 7:
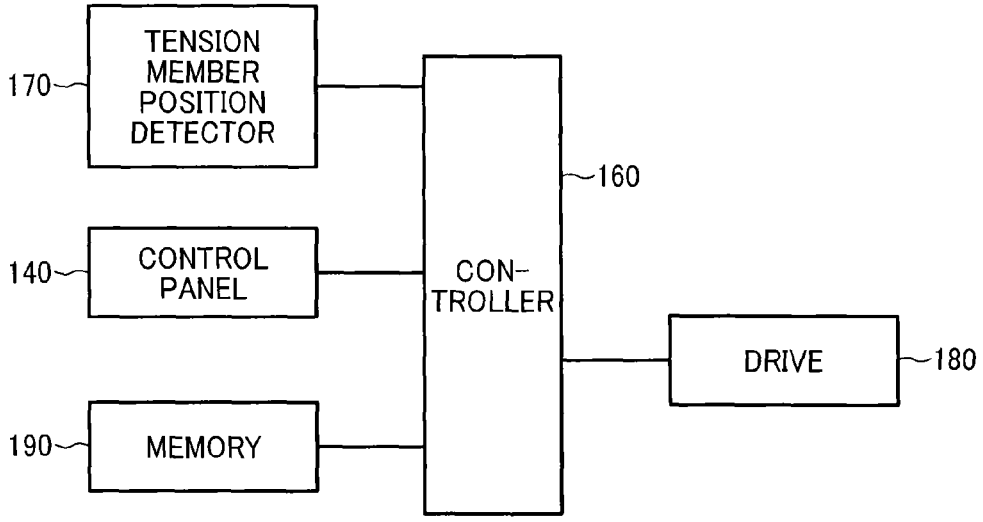
FIG. 7 is a block diagram illustrating a controller that automatically controls pressing of a camshaft.

It is to be noted that the eccentric cam unit 135 can replace the lever 132*b* that is operated manually with a solenoid and a monitor to automatically control to press down the camshaft 132. At this time, as illustrated in the block diagram of FIG. 7, a controller 160 checks the type of a recording medium specified via a control panel 140 of the apparatus body 200 with information stored in a memory 190 (the type of the recording medium and movability (movable or non-movable) of the tension member 130) and determines whether or not to drive a drive 180 of the tension member 130. At this time, the controller 160 may cause a tension member position detector 170 to confirm the position of the tension member 130 before controlling the operation of the drive 180 to rotate of the camshaft 132. The tension member position detector 170 is an optical sensor, for example. Specifically, the tension member position detector 170 may be located at a position shown in the diagram (b) of FIG. 6, for example. When the lever 132*b* is rotated to the position, light emitted from the tension member position detector 170 is blocked, thereby detecting the pressing down of the camshaft 132.

It is to be noted that the tension member 130 is not limited to the configuration in which the tension member 130 is moved by the eccentric cam unit 135 illustrated in diagrams (a) and (b) of FIG. 6. For example, the tension member 130 can be previously fixed at a position indicted with a solid line in FIG. 5 and the diagram (b) of FIG. 6.

Figure 8:
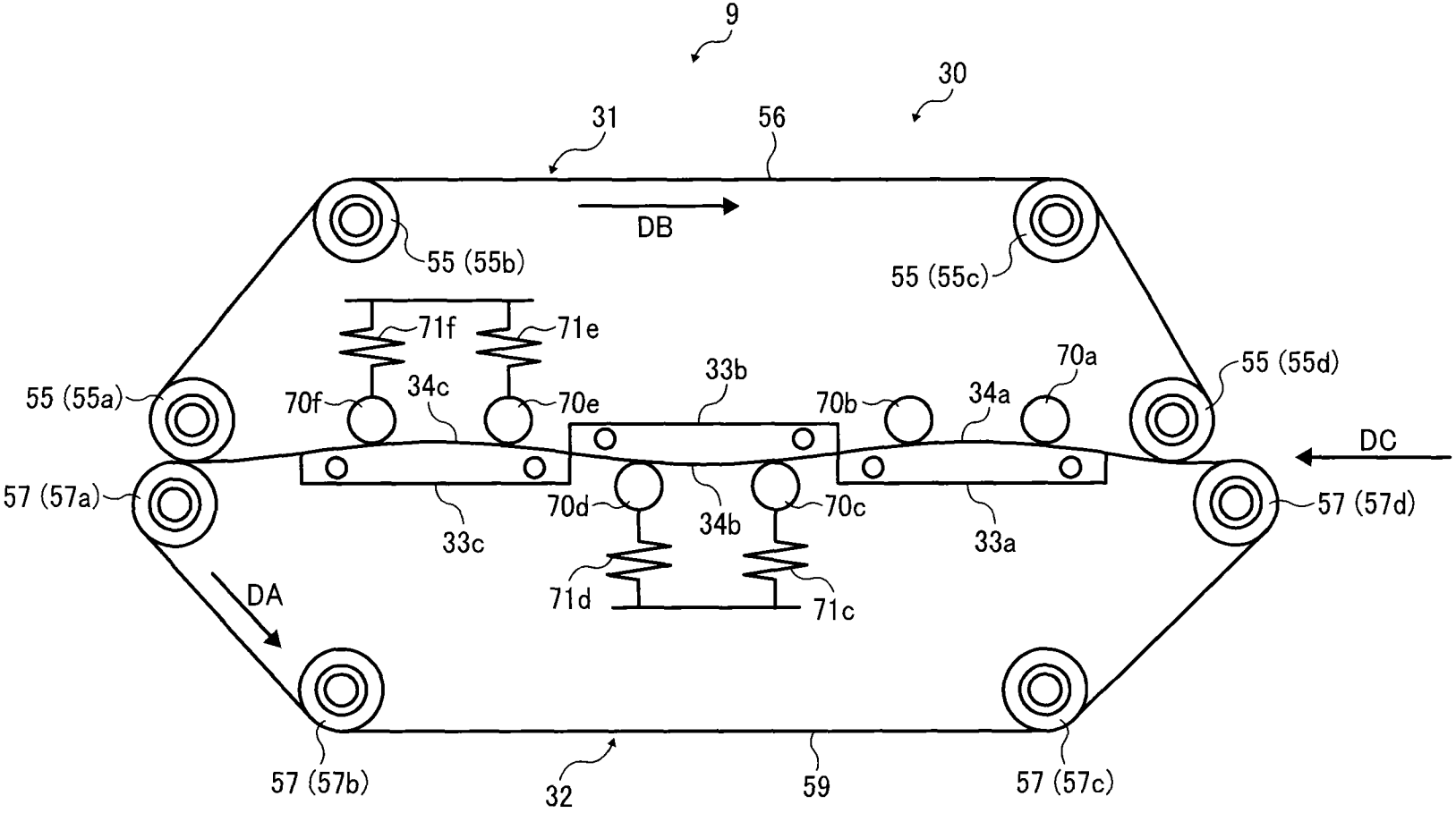
FIG. 8 is an enlarged view of the cooling device of FIG. 1.

FIG. 8 is an enlarged view of the cooling device 9 of FIG. 1.

The cooling device 9 includes pressing rollers 70*a*, 70*b*, 70*c*, 70*d*, 70*e*, and 70*f*. As illustrated in FIG. 8, the pressing rollers 70*a*, 70*b*, 70*c*, 70*d*, 70*e*, and 70*f* are disposed in contact with the respective inner circumferential surface of the belts 56 and 59 and facing the cooling members 33*a*, 33*b*, and 33*c*, accordingly.

The pressing rollers 70*a* and 70*b* are disposed in contact with and above the cooling member 33*a* with the belts 56 and 59 interposed therebetween. The pressing rollers 70*a* and 70*b* presses the cooling member 33*a* with the own weight via the belts 56 and 59. The pressing rollers 70*e* and 70*f* are disposed in contact with and above the cooling member 33*c* with the belts 56 and 59 interposed therebetween. The pressing rollers 70*e* and 70*f* presses the cooling member 33*c* via the belts 56 and 59. The pressing rollers 70*c* and 70*d* are disposed in contact with and below the cooling member 33*b* with the belts 56 and 59 interposed therebetween. The pressing rollers 70*c* and 70*d* presses the cooling member 33*b* against the force of gravity via the belts 56 and 59.

Here, the pressing rollers 70*c*, 70*d*, 70*e*, and 70*f* receives the biasing force from the biasing members 71*c* and 71*d*, 71*e*, and 71*f* to press the cooling members 33*b* and 33*c*. (A detailed description of this configuration is described below with reference to FIGS. 16, 17, 18A, and 18B.) At this time, the pressing forces of the pressing rollers 70*a* and 70*b* disposed upstream in the recording medium conveying direction are set to be smaller than the pressing forces of the pressing rollers 70*c*, 70*d*, 70*e*, and 70*f* disposed downstream in the recording medium conveying direction. In the present example, the biasing members 71*c* and 71*d*, 71*e*, and 71*f* are springs such as leaf springs and coil springs.

Each pressing roller (i.e., the pressing rollers 70*a*, 70*b*, 70*c*, 70*d*, 70*e*, and 70*f* includes a rotary member that contacts the cooling member (i.e., the cooling members 33*a*, 33*b*, and 33*c*) via the belts 56 and 59 and a rotary shaft that rotates the rotary member. The respective rotary members of the pressing rollers 70*a*, 70*b*, 70*c*, 70*d*, 70*e*, and 70*f* have identical materials (such as sponge and rubber) and weights. The respective rotary shafts of the pressing rollers 70*a*, 70*b*, 70*c*, 70*d*, 70*e*, and 70*f* are formed of different materials. Specifically, the rotary shafts of the pressing rollers 70*c*, 70*d*, 70*e*, and 70*f* are formed of metal and the rotary shafts of the pressing rollers 70*a* and 70*b* are formed of a material having a weight lighter than metal, for example, aluminum. When the rotary shafts of the pressing rollers 70*a* and 70*b* are formed of aluminum, a pressing force of the pressing rollers 70*a* and 70*b* is preferably 1.5N, for example. Similarly, when the rotary shafts of the pressing rollers 70*c*, 70*d*, 70*e*, and 70*f* are formed of metal, a pressing force of the pressing rollers 70*c*, 70*d*, 70*e*, and 70*f* is preferably 3.5N, for example. Further, it is preferable that the pressing rollers 70*c*, 70*d*, 70*e*, and 70*f* provided with the biasing members 71*c*, 71*d*, 71*e*, and 71*f*, respectively, have a pressing force between 8N and 14N.

However, the pressing rollers 70*c* and 70*d* press the cooling member 33*b* against the force of gravity. Therefore, the rotary shafts of the pressing rollers 70*a*, 70*b*, 70*c*, and 70*d* may be formed of aluminum and the rotary shaft of the pressing rollers 70*e* and 70*f* may be formed of metal. With this configuration, the biasing force of the biasing members 71*c*, 71*d*, 71*e*, and 71 f of the respective pressing rollers 70*c*, 70*d*, 70*e*, and 70*f* can be adjusted such that the pressing force of the pressing rollers 70*a* and 70*b* is set to be smaller than the pressing force of the pressing rollers 70*c*, 70*d*, 70*e*, and 70*f*. Further, as long as the pressing force of the pressing rollers 70*a* and 70*b* is smaller than the pressing force of the pressing rollers 70*e* and 70*f*, the pressing rollers 70*e* and 70*f* can do without the biasing members 71*e* and 71*f* and may press the cooling member 33*c* by the own weight. In other words, the pressing rollers 70*a* and 70*b* have the smallest pressing force of the pressing rollers 70*a* through 70*f*.

Figure 9:
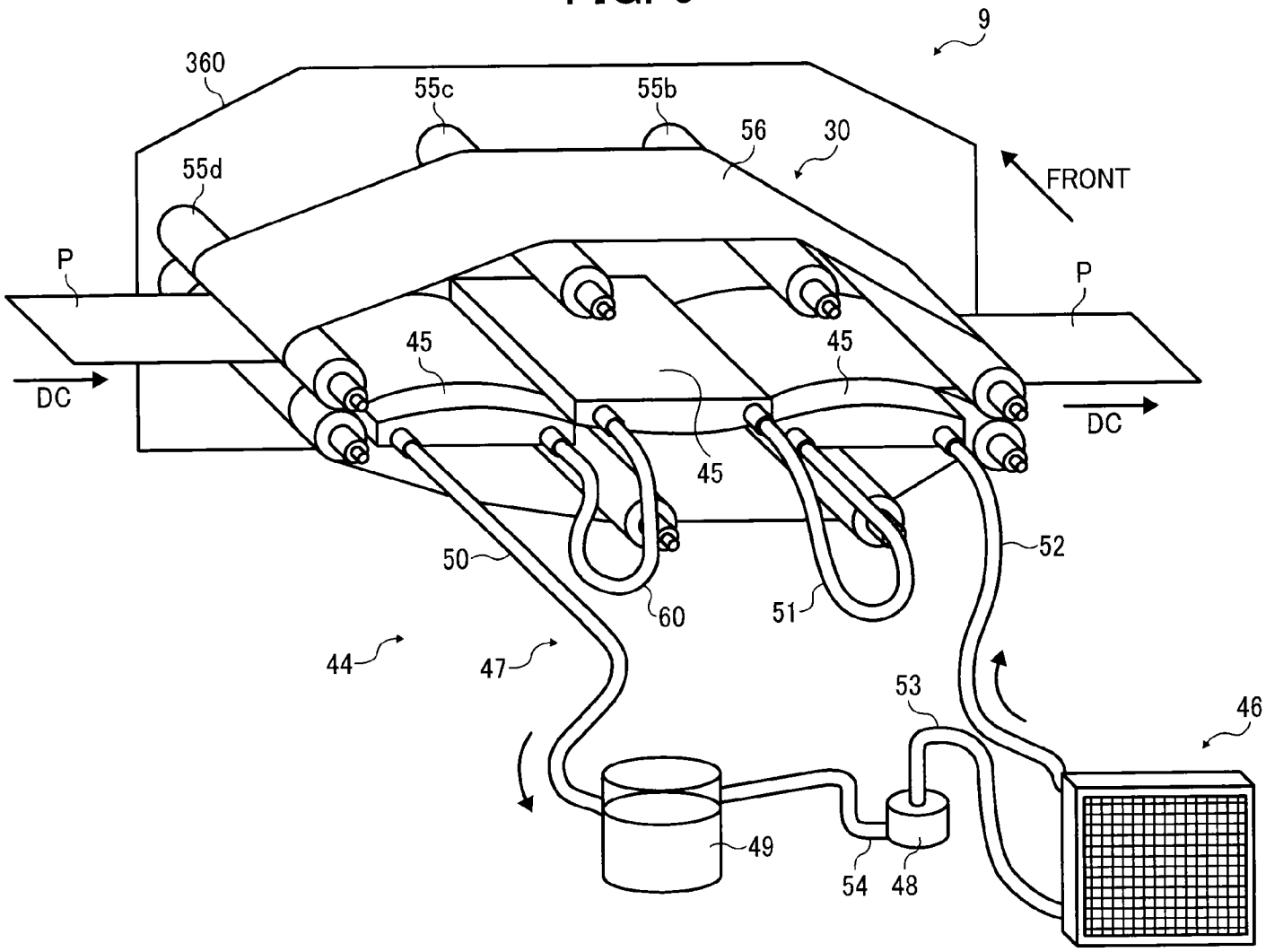
FIG. 9 illustrates a rear side of the cooling device of FIG. 8.
Figure 10:
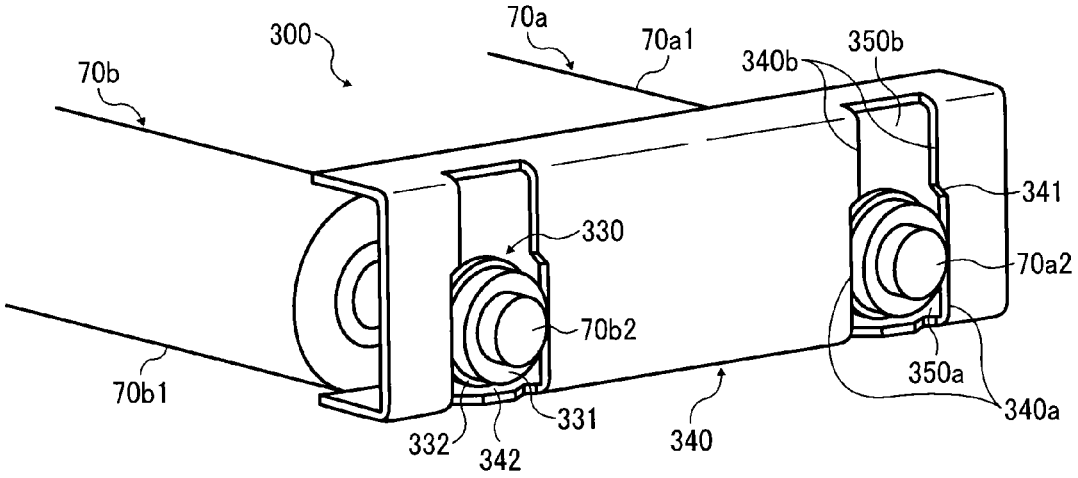
FIG. 10 is a perspective view of a pressing member that presses a cooling member by the own weight of the pressing member.

FIG. 9 illustrates a rear side of the cooling device 9 of FIG. 8. FIG. 10 is a perspective view of the pressing rollers 70*a* and 70*b* that press the cooling member 33*a* by the own weight of the pressing rollers 70*a* and 70*b*. The pressing rollers 70*a* and 70*b* form a pressing roller unit 300 that includes the pressing rollers 70*a* and 70*b*, two bearing guides 340, and a frame (see FIG. 9). The pressing rollers 70*a* and 70*b* and the bearing guides 340 are attached to a frame 360. The pressing rollers 70*a* and 70*b* have respective roller covers 70*a*1 and 70*b*1, respective rotary shafts 70*a*2 and 70*b*2, and two bearings 330 mounted on each of the respective rotary shafts 70*a*2 and 70*b*2. FIG. 10 shows one end of the pressing roller unit 300. However, since an opposed end of the pressing roller unit 300 has an identical configuration to the one end thereof, the drawing of the opposed end of the pressing roller unit 300 is omitted here.

The bearings 330 includes a cylindrical part 331 and a flange 332. The cylindrical part 331 is arranged outside the bearing guide 340 in the axial direction of the pressing rollers 70*a* and 70*b*. The flange 332 is arranged inside the bearing guide 340 in the axial direction of the pressing rollers 70*a* and 70*b* and extends outside from the cylindrical part 331 in a radical direction of the pressing rollers 70*a* and 70*b*. The bearing guide 340 is formed of a flat metal sheet bent to a nearly U-shaped cross section. The bearing guide 340 extends vertically to the axial direction of the roller covers 70*a*1 and 70*b*1 and is secured by screws to the frame 360 of the cooling device 9 (see FIG. 9). FIG. 9, however, is simplified by not illustrating the frame 360 at the near side of the cooling device 9. The bearing guide 340 includes guide pairs 340*a* and 340*b*. The guide pairs 340*a* and 340*b* extend substantially parallel to each other in a pressing direction (the vertical direction) of the pressing rollers 70*a* and 70*b* and are joined at a step 341. The width of a cut 350*a* is greater than the width of a cut 350*b*. The widths of the cuts 350*a* and 350*b* in the recording medium conveying direction are defined by the guide pairs 340*a* and 340*b* of the bearing guide 340.

The width of the cut 350*a* defined by the guide pair 340*a* is smaller than the diameter of the flange 332 and is greater than the diameter of the cylindrical part 331. The cylindrical part 331 is projected outwardly in the axial direction of the pressing roller (i.e., the pressing rollers 70*a* and 70*b* in FIG. 10) through the cut 350*a* defined by the guide pair 340*a*. By contrast, the cut 350*b* defined by the guide pair 340*b* located upper than the step 341 is smaller than the diameter of the cylindrical part 331. Consequently, the bearing 330 is guided by the guide pair 340*a* and can move vertically in the cut 350*a* while movement of the cylindrical part 331 upper than the step 341 is restricted by the step 341.

Further, as illustrated in FIG. 10, the flange 332 has a diameter greater than the width of the cut 350*a* and is arranged on the inner side in the axial direction of the pressing roller (i.e., the pressing rollers 70*a* and 70*b* in FIG. 10) than the bearing guide 340. Since the pressing rollers 70*a* and 70*b* have the bearings 330 having identical configurations at both ends, movement of the pressing rollers 70*a* and 70*b* in the axial direction thereof is restricted. Further, since a lower part of the flange 332 contacts a bottom face 342 of the bearing guide 340, further movement of the bearing 330 in a downward direction is restricted.

As a result, the bearing 330 can move vertically in the cut 350*a* and, as long as the bearing 330 remains away from the step 341 or the bottom face 342 of the bearing guide unit 340 without contacting, the pressing rollers 70*a* and 70*b* press the cooling member 33*c* by the own weight.

It is to be noted that, when the pressing roller unit includes one or more biasing members, a spring is employed. More preferably, the pressing roller unit employs a leaf spring extending in the axial direction of the roller covers 70*a*1 and 70*b*1. In this case, one end of the leaf spring is secured to a frame disposed facing the roller covers 70*a*1 and 70*b*1 and an opposed end of the leaf spring is a free end projected outwardly in the axial direction from the cut 350*b*, so as to press the flange 332 downwardly. The biasing force can be adjusted by the thickness and width of the leaf spring. In the assembled pressing roller unit, the pressing rollers 70*c*, 70*d*, 70*e*, and 70*f* are pressed by the biasing members 71*c*, 71*d*, 71*e*, and 71*f* with a given biasing force. Therefore, if the pressing roller unit is attached to the cooling device 9, the cooling member (i.e., the cooling members 33*b* and 33*c*) disposed facing the pressing roller unit is pressed by the belts 56 and 59. The pressing roller unit that includes the biasing members 71*c* and 71*d* or the biasing members 71*e* and 71*f* can include the pressing rollers 70*c* and 70*d* or the pressing rollers 70*e* and 70*f* illustrated in FIG. 8.

By employing the pressing roller unit, the pressing roller unit including two rotary members, for example, can be attached to the cooling device 9 and can perform maintenance easily.

It is to be noted that, when the pressing roller unit having two rotary members (i.e., the pressing rollers 70*a* and 70*b*), the weights of the rotary members (i.e., the rotary shafts 70*a*2 and 70*b*2) are changed such that the pressing force of the pressing roller 70*a* disposed upstream in the recording medium conveying direction may be set to be smaller than the pressing force of the pressing roller 70*b* disposed downstream in the recording medium conveying direction.

In a comparative example, if the pressing force of the pressing rollers is increased, wrinkle or crease on the recording medium under conveyance is generated. By contrast, a reduction in the pressing force of the pressing rollers causes an unstable state of the cooling member and the recording medium with the belt interposed therebetween, which contributes to a decline in effectiveness of cooling. Thus, by providing the cooling device 9 having the above-described configuration, crease on the recording medium P can be more reduced when compared with the configuration in which the pressing rollers have identical pressing forces to each other.

When the recording medium P that is ejected from the fixing device 8 is a thin paper, it is likely that the recording medium P is bent or warped when conveyed between the fixing device 8 and the cooling device 9. If the recording medium P having the bent (warped) part is pressed hard by the belts 56 and 59 of the cooling device 9, the bent part is crushed to generate crease on the recording medium P. Specifically, if the upstream-side pressing roller in the recording medium conveying direction is greater in the pressing force than the downstream-side pressing roller, crease is made by the pressing rollers 70*a* and 70*b* disposed at the most upstream side and the recording medium P is conveyed to the downstream side. By contrast, if the pressing rollers 70*a* and 70*b* are not disposed, the recording medium P does not contact the cooling member firmly via the belt, and therefore the effectiveness of cooling is reduced.

To address such inconvenience, by holding the recording medium P between the belts 56 and 59 with an appropriate pressing force of the pressing rollers 70*a* and 70*b*, occurrence of crease is prevented. Once the recording medium P successfully enters between the belts 56 and 59 with no crease thereon, the recording medium P can remain creaseless thereafter even if the pressing rollers 70*c*, 70*d*, 70*e*, and 70*f* press the recording medium P with greater pressing forces.

Table 3 shows results of a test checking the frequency of occurrence of crease on the recording medium P in the cooling device 9 having different configurations. In a column of Crease on Recording Medium P, "Poor" represents a level that crease is confirmed visually, "Acceptable" represents a level that crease is confirmed visually and has no big influence on quality, and "Good" represents a level that crease is not confirmed visually. In a column of Effectiveness of Cooling, "Good" represents the recording medium P is cooled sufficiently and is not adversely affected by toner blocking in which adjacent recording media are adhered to each other due to coagulation of toner particles thereon even when multiple recording media are layered on each other.

TABLE 3

| | Crease on Recording Medium P | Effectiveness of Cooling |
|---|---|---|
| Configuration 1 | Poor | Good |
| Configuration 2 | Acceptable | Good |
| Configuration 3 | Good | Good |

Here, the pressing rollers 70*a*, 70*b*, 70*c*, 70*d*, 70*e*, and 70*f* included in the cooling device 9 of Configuration 1 were biased by respective biasing members so as to have an identical pressing force (about 12N).

The pressing rollers 70*a*, 70*b*, 70*c*, 70*d*, 70*e*, and 70*f* included in the cooling device of Configuration 2 had respective rotary members formed of an identical material (sponge) and respective rotary shafts formed of metal, so as to have an identical weight (about 3.5N). Further, the pressing rollers 70*c* and 70 were biased by springs each having a pressing force of about 15.5N. The pressing rollers 70*e* and 70*f* were biased by springs each having a pressing force of about 8.5N. The pressing rollers 70*a* and 70*b* were not biased by springs but pressed the cooling member 33*a* by the own weight. Consequently, the pressing rollers 70*a* and 70*b* had the pressing force of about 3.5N and the pressing rollers 70*c*, 70*d*, 70*e*, and 70*f* had the pressing force of about 12N.

In the pressing rollers 70*a*, 70*b*, 70*c*, 70*d*, 70*e*, and 70*f* included in the cooling device of Configuration 3, the weights of the pressing rollers 70*a* and 70*b* (about 1.5N) were smaller than the weights of the pressing rollers 70*c*, 70*d*, 70*e*, and 70*f* (about 3.5N). At this time, the pressing rollers 70*a*, 70*b*, 70*c*, 70*d*, 70*e*, and 70*f* had respective rotary members formed of an identical material (sponge) while the pressing rollers 70*c* and 70*d*, 70*e*, and 70*f* had respective rotary shafts formed of metal and the pressing rollers 70*a* and 70 had respective rotary shafts formed of aluminum. Further, the pressing rollers 70*c* and 70 were biased by springs each having a pressing force of about 15.5N. The pressing rollers 70*e* and 70*f* were biased by springs each having a pressing force of about 8.5N. The pressing rollers 70*a* and 70*b* were not biased by springs but pressed the cooling member 33*a* by the own weight. Consequently, the pressing rollers 70*a* and 70*b* had the pressing force of about 1.5N and the pressing rollers 70*c*, 70*d*, 70*e*, and 70*f* had the pressing force of about 12N.

From the test results of Configurations 2 and 3 shown in Table 3, it was found that, by providing the pressing force of the pressing rollers disposed facing the cooling member 33*a* located at the extreme upstream side of the cooling device 9 smaller than the pressing force of the pressing rollers disposed at the downstream side, occurrence of crease on the recording medium can be reduced and preferable effectiveness of cooling can be obtained. By contrast, from the test results of Configuration 1 shown in Table 3, when the pressing force of the pressing rollers disposed at the extreme upstream side of the cooling device 9 is greater than the pressing force of the pressing rollers disposed at the downstream side, preferable effectiveness of cooling was achieved but crease was made on the recording medium.

Figure 11A:
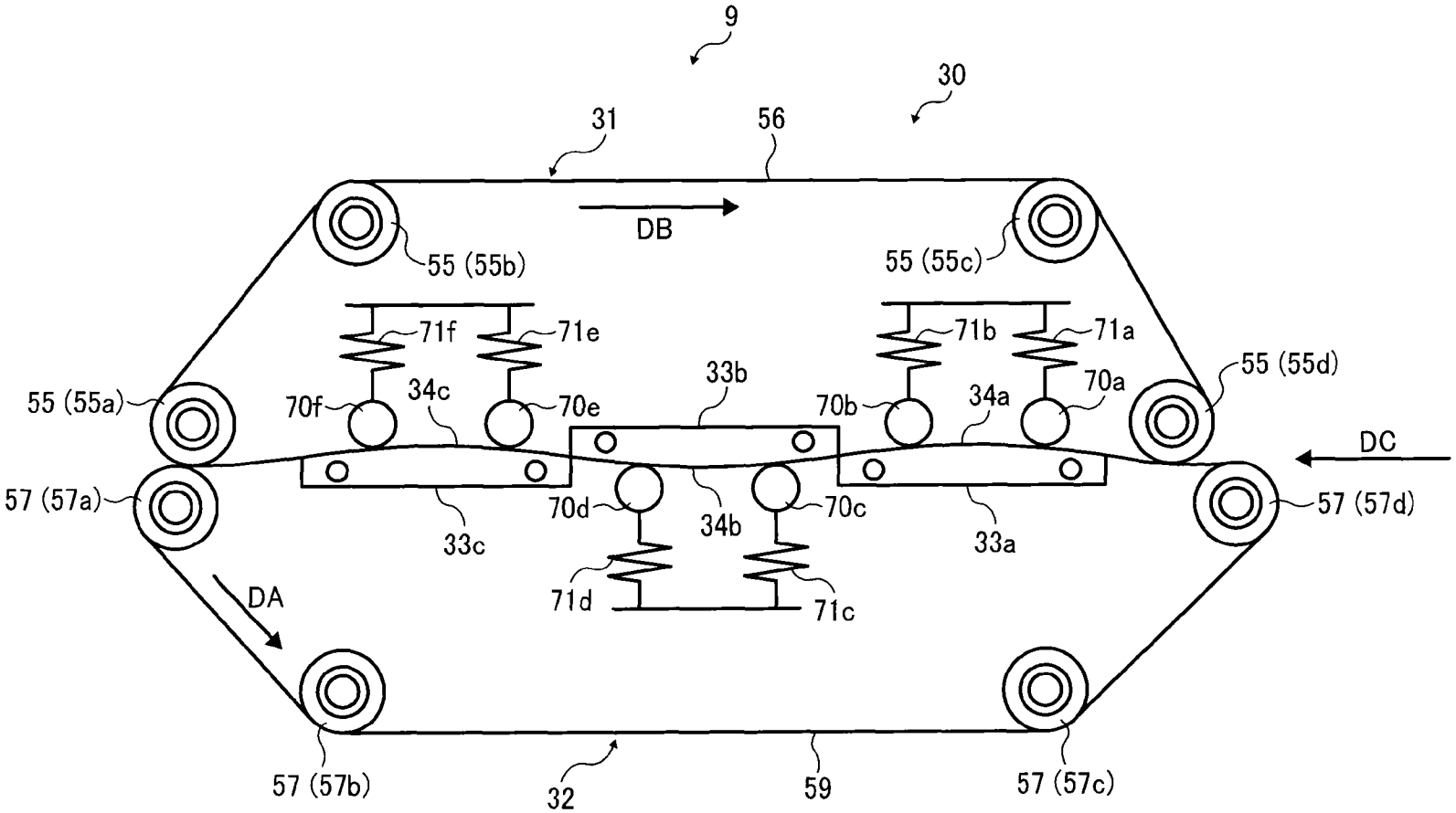
FIG. 11A illustrates a schematic configuration of a cooling device according to yet another example of this disclosure.
Figure 11B:
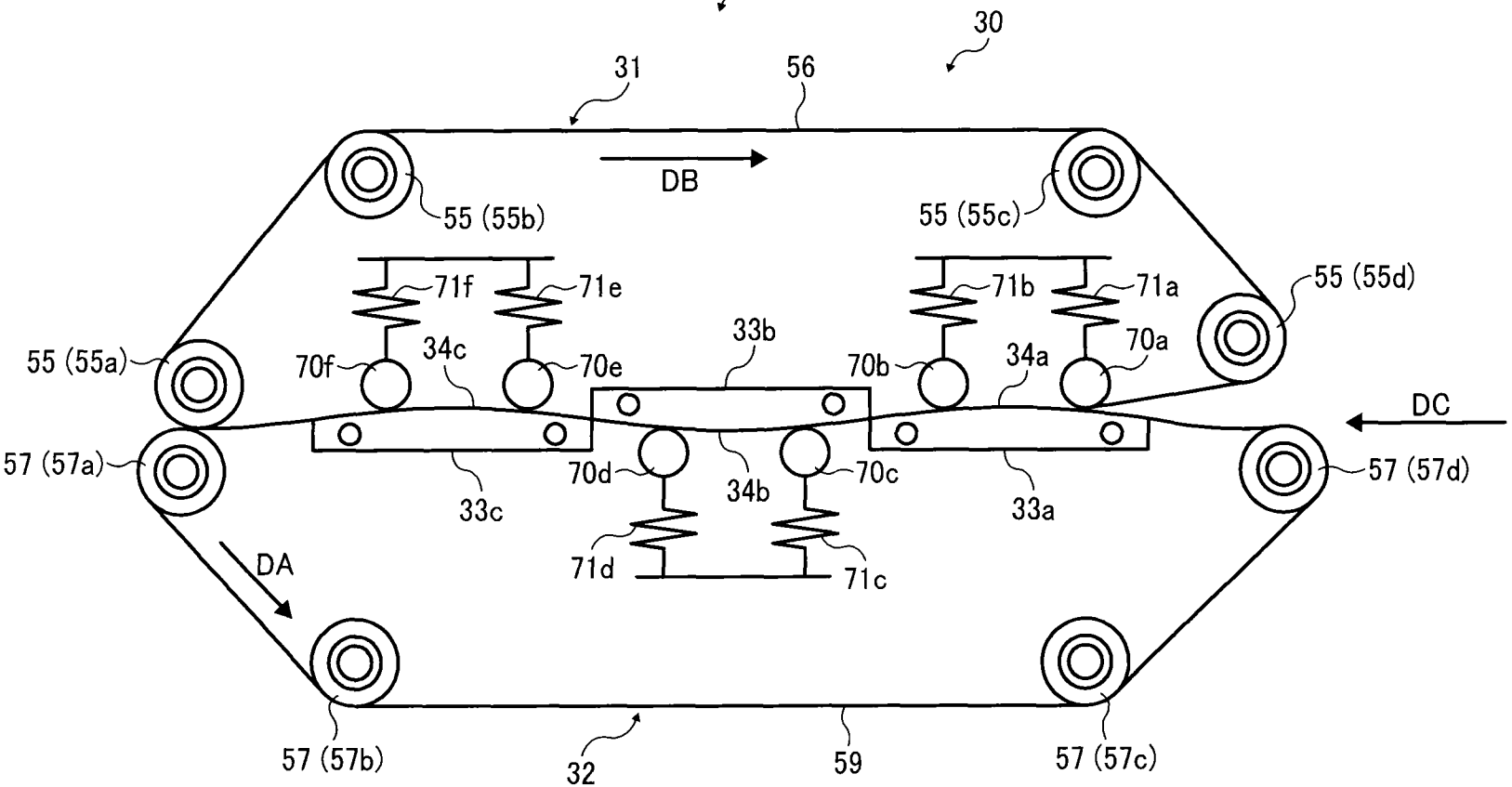
FIG. 11B illustrates a variation of the cooling device of FIG. 11A.

FIG. 11A illustrates a schematic configuration of a cooling device 9 according to yet another example of this disclosure. FIG. 11B illustrates a variation of the cooling device 9 of FIG. 11A.

The basic configuration of the cooling device 9 illustrated in FIG. 11A is identical to the cooling device 9 illustrated in FIG. 8, except that the pressing rollers 70*a* and 70*b* are biased by biasing members 71*a* and 71*b*, in other words, the whole pressing rollers (i.e. the pressing rollers 70*a*, 70*b*, 70*c*, 70*d*, 70*e*, and 70*f*) are biased by the respective biasing members (i.e., the biasing members 71*a*, 71*b*, 71*c*, 71*d*, 71*e*, and 71*f*). The biasing members 71*a*, 71*b*, 71*c*, 71*d*, 71*e*, and 71*f* are springs. While the spring constant of each biasing member is arbitrary, the pressing force of the pressing rollers 70*a* and 70*b* disposed at the upstream side in the recording medium conveying direction is set to be smaller than the pressing force of the pressing rollers 70*c*, 70*d*, 70*e*, and 70*f* disposed at the downstream side. The material of the rotary shaft of each pressing roller is also arbitrary. Therefore, the spring constant of each biasing member can be adjusted based on the material of the rotary shaft of each pressing roller. This configuration can obtain the same effect as the above-described effect.

As described above, the cooling device 9 illustrated in FIG. 11B is a variation of the cooling device 9 illustrated in FIG. 11A. The cooling device 9 according to the examples of this disclosure includes the biasing members having the identical structure to each other. The lowest point of the roller 55*d* is disposed higher than the lowest point of the pressing rollers 70*a* and is separated from the roller 57*d*. With this arrangement of the roller 55*d*, another force is added to move the pressing roller 70*a* upward. Therefore, even if the biasing members have identical configurations to each other, the pressing force of the pressing rollers 70*a* and 70*b* disposed at the upstream side of the cooling device 9 in the recording medium conveying direction can be set smaller than the pressing force of the pressing rollers 70*c*, 70*d*, 70*e*, and 70*f* disposed at the downstream side. Further, the trajectory of the belt 56 between the roller 55*d* and the pressing rollers 70*a* inclines downwardly from the upstream side to the downstream side in the recording medium conveying direction. Consequently, even if the leading edge of the recording medium P is curled upward, the recording medium P can be guided between the belts 56 and 59 easily.

Figure 12:
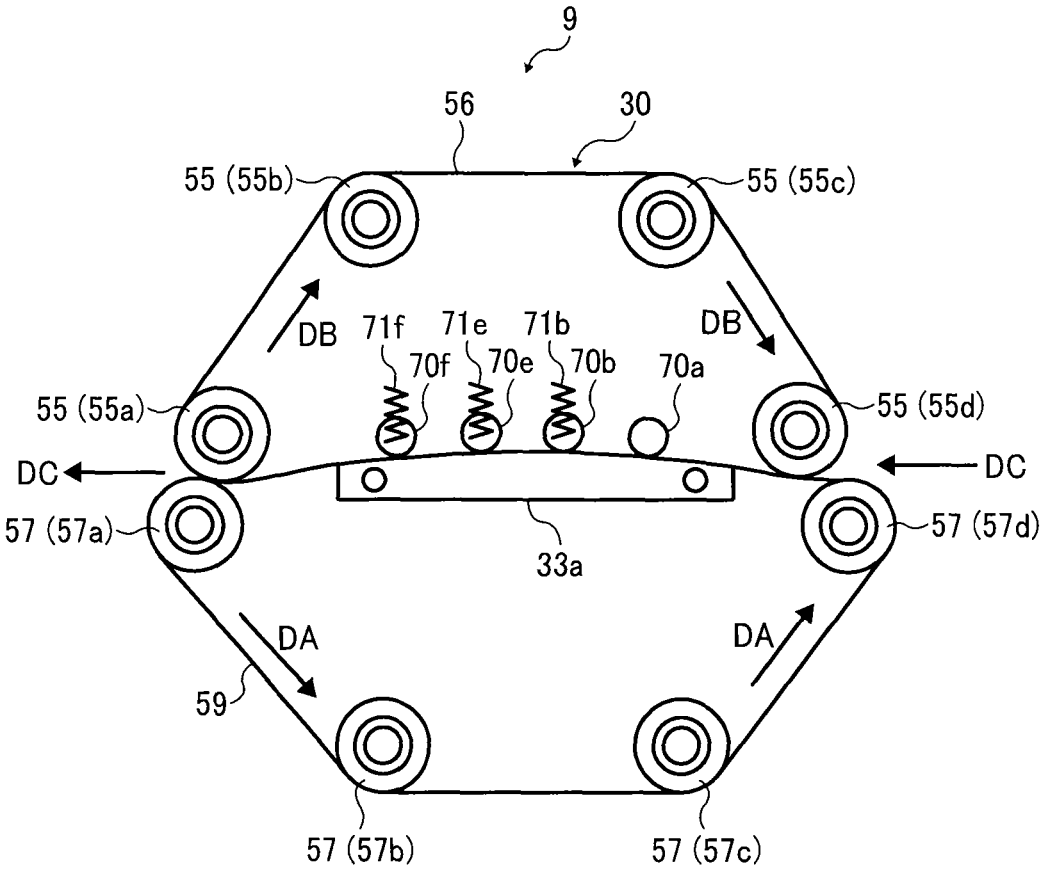
FIG. 12 illustrates a schematic configuration of a cooling device according to yet another example of this disclosure.

FIG. 12 illustrates a schematic configuration of the cooling device 9 according to yet another example of this disclosure.

In the present example, the cooling device 9 has a single cooling member 33*a* and the pressing force of the pressing roller 70*a* disposed at the upstream side in the recording medium conveying direction is set smaller than the pressing force of the pressing rollers 70*b*, 70*e*, and 70*f* disposed at the downstream side. As described above, multiple pressing rollers, which are the pressing rollers 70*a*, 70*b*, 70*e*, and 70*f* are arranged along the recording medium conveying direction. Respective rotary shafts and respective rotary members of the pressing rollers 70*a*, 70*b*, 70*e*, and 70*f* are identical to each other. The pressing rollers 70*a* presses the cooling member 33*a* by the own weight while the pressing rollers 70*b*, 70*e*, and 70*f* press the cooling member 33*a* with respective pressing forces each combined by the own weight and respective biasing forces of the biasing members 71*b*, 71*e*, and 71*f*. This configuration can obtain the same effect as the above-described effect.

In the present example illustrated in FIG. 12, the pressing rollers of the cooling device 9 according to this example of this disclosure include the biasing members having the identical structure to each other as illustrated in FIG. 11B and the lower limit position of the roller 55*d* can be disposed higher than the lower limit position of the pressing roller 70*a* so as to add a force to move the pressing roller 70*a* upwardly.

Figure 13:
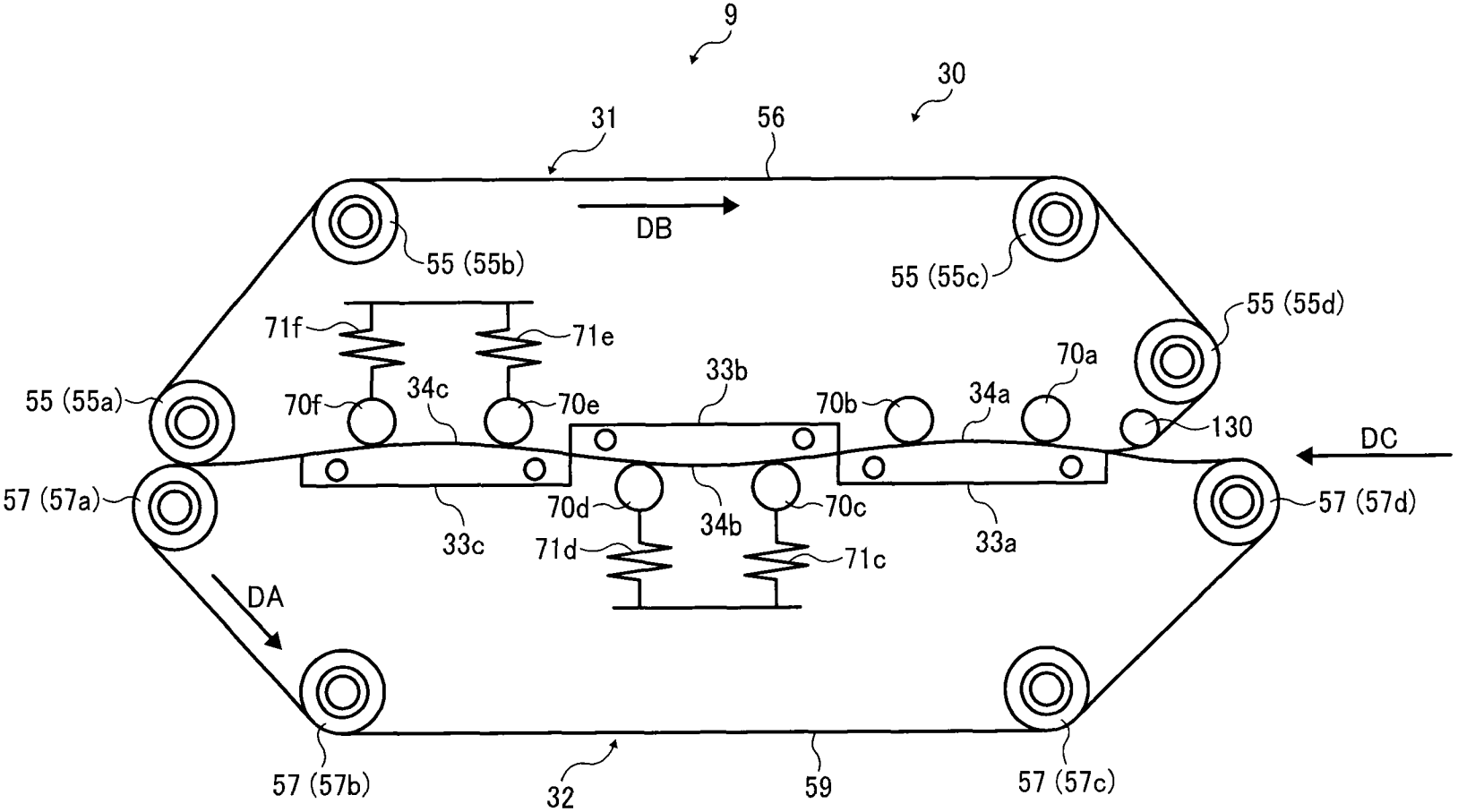
FIG. 13 is a side view of a cooling device according to yet another example of this disclosure.

FIG. 13 is a side view of the cooling device 9 according to yet another example of this disclosure.

As illustrated in FIG. 13, the cooling device 9 includes the pressing rollers 70*a* and 70*b*, 70*c*, 70*d*, 70*e*, and 70*f* and the tension member 130. The cooling device 9 illustrated in FIG. 13 has a basically identical configuration to the cooling device 9 illustrated in FIG. 2, except that the cooling device 9 includes the pressing rollers 70*a* and 70*b*, 70*c*, 70*d*, 70*e*, and 70*f* and the tension member 130. As illustrated in FIG. 13, the respective pressing rollers 70*a* and 70*b*, 70*c*, 70*d*, 70*e*, and 70*f* are disposed facing the cooling members 33*a*, 33*b*, and 33*c* and in contact with the respective inner circumferential surfaces of the belts 56 and 59 interposed therebetween.

The pressing rollers 70*a* and 70*b* are disposed above the cooling member 33*a* and press the cooling member 33*a* by the own weight (as described above) via the belts 56 and 59. The pressing rollers 70*c*, 70*d*, 70*e*, and 70*f* receive the respective biasing forces of the biasing members 71*c*, 71*d*, 71*e*, and 71*f* to press the cooling members 33*b* and 33*c*.

Figure 14:
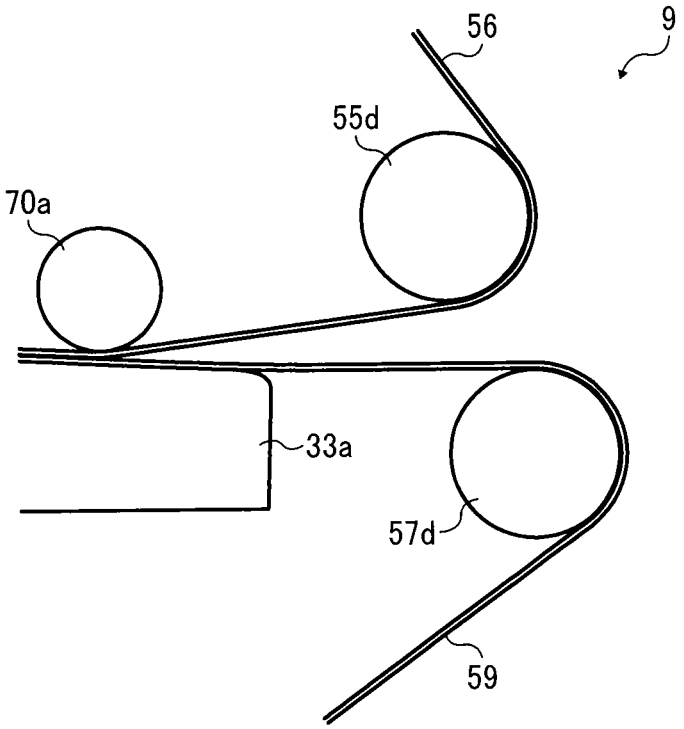
FIG. 14 is a side view of the cooling device without the tension member.

Due to the pressing rollers 70*c*, 70*d*, 70*e*, and 70*f*, the recording medium P can contact the cooling members 33*a*, 33*b*, and 33*c* easily. As illustrated in FIG. 14, if the tension member 130 is not provided and the belt 56 is not stretched downwardly, the pressing roller 70*a* receives a force from the belt 56 to move upwardly away from the cooling member 33*a*. Further, the belt 56 that extends from the roller 55*d* toward the recording medium conveying direction remains separated from the belt 56 until the belt 56 reaches a contact position with the pressing roller 70*a*.

Consequently, a weaker force is applied by the pressing rollers to hold the recording medium P between the belts 56 and 59, and therefore the conveying performance of the recording medium P is likely to become unstable. Further, a contact force of the recording medium P and the cooling member 33*a* at the upstream side in the recording medium conveying direction is reduced or eliminated, and therefore it is not likely that the cooling member 33*a* cools the recording medium P sufficiently. Therefore, when compared when a configuration that employs the biasing members to bias the pressing rollers 70*a* and 70*b*, the configuration that includes the pressing rollers 70*a* and 70*b* pressing the cooling member 33*a* by the own weight can cause more remarkable inconvenience.

By contrast, by providing the tension member 130 between the roller 55*d* and the pressing rollers 70*a* and upstream from the cooling member 33*a* in the recording medium conveying direction as illustrated in FIG. 13, a force applied to the pressing roller 70*a* from the belt 56 in a direction in which the pressing roller 70*a* separates from the cooling member 33*a* (in the upward direction in FIG. 14) can be reduced. Further, since the contact area of the belts 56 and 59 can be expanded, the recording medium P can contact the cooling member 33*a* more widely in the recording medium conveying direction.

Figure 15A:
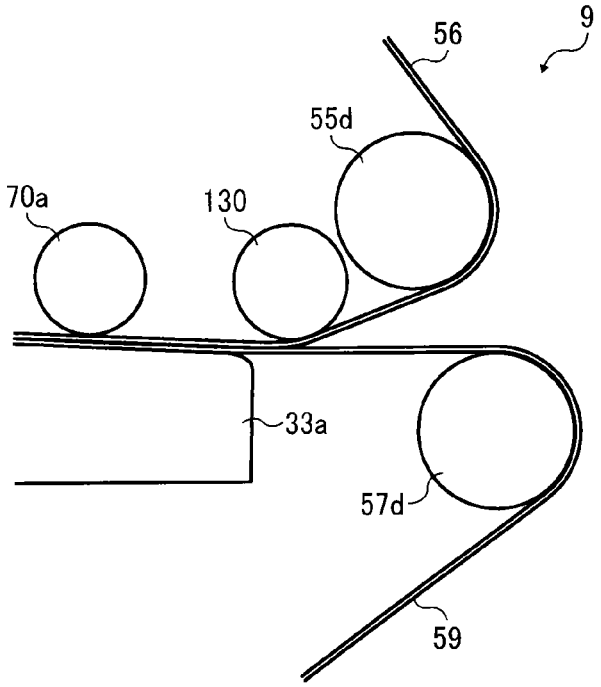
FIG. 15A is an enlarged partial view of the cooling device of FIG. 13 with the tension member contacting an upper belt.
Figure 15B:
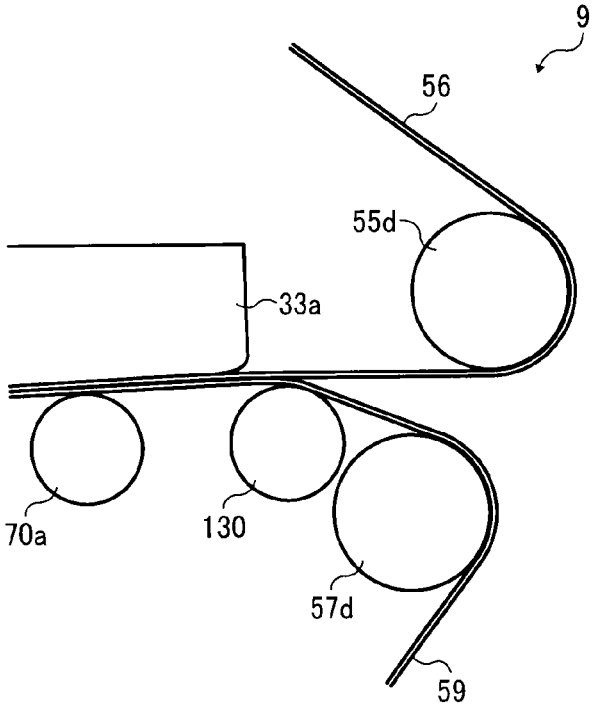
FIG. 15B is an enlarged partial view of the cooling device of FIG. 13 with the tension member contacting a lower belt.

FIG. 15A is an enlarged partial view of the cooling device 9 of FIG. 13 with the tension member 130 contacting the belt 56. FIG. 15B is an enlarged partial view of the cooling device of FIG. 13 with the tension member contacting the belt 59.

As illustrated in FIG. 15A, the cooling device 9 includes the tension member 130 that functions as a first rotator to stretch the belt 56. The pressing roller 70*a* is disposed at the upstream side of the cooling device 9 in the recording medium conveying direction and the tension member 130 is disposed further upstream from the pressing roller 70*a* in the recording medium conveying direction. The roller 55*d* that functions as a second rotator is provided to stretch the belt 56 more upstream than the tension member 130 in the belt rotation direction. The tension member 130 is located between the roller 55*d* and the pressing rollers 70*a*. The lowest point of the roller 55*d* is located higher than the lowest point of the pressing rollers 70*a*. The lowest point of the tension member 130 is located at a height equal to or lower than the lowest point of the pressing rollers 70*a*. By disposing the lowest point of the tension member 130 at the height same as or lower than the lowest point of the pressing rollers 70*a* disposed at the upstream side, a force applied to the pressing roller 70*a* in the direction in which the pressing roller 70*a* separates from the cooling member 33*a* can be more reduced. By so doing, original functions of the pressing roller 70*a* to press the cooling member 33*a* by the own weight is guaranteed. It is to be noted that the lowest point of the roller 55*d* is arranged higher than the lowest point of the pressing rollers 70*a* disposed at the upstream side. Further, the trajectory of the belt 56 between the tension member 130 and the roller 55*d* inclines downwardly from the upstream side to the downstream side in the recording medium conveying direction. Consequently, even if the leading edge of the recording medium P is curled upward, the recording medium P can be guided between the belts 56 and 59 easily. Further, since the tension member 130 widens the contact area of the belt 59 and the belt 56, the recording medium P can contact the cooling member 33*a* widely along the recording medium conveying direction.

In FIG. 13, similar to the pressing rollers 70*c*, 70*d*, 70*e*, and 70*f*, the pressing rollers 70*a* and 70*b* can be biased by biasing forces applied by the biasing member to press the cooling member 33*a* without pressing the cooling member 33*a* by the own weight.

Next, a description is given of a detailed configuration of the biasing members 71*c*, 71*d*, 71*e*, and 71*f*, with reference to FIGS. 16 through 28. The configuration of the biasing members 71*c*, 71*d*, 71*e*, and 71*f* can be applied to any pressing rollers as well as the pressing rollers 70*c*, 70*d*, 70*e*, and 70*f*. For example, the following description is made with the output roller pair unit 16 illustrated in FIG. 1.

Figure 16:
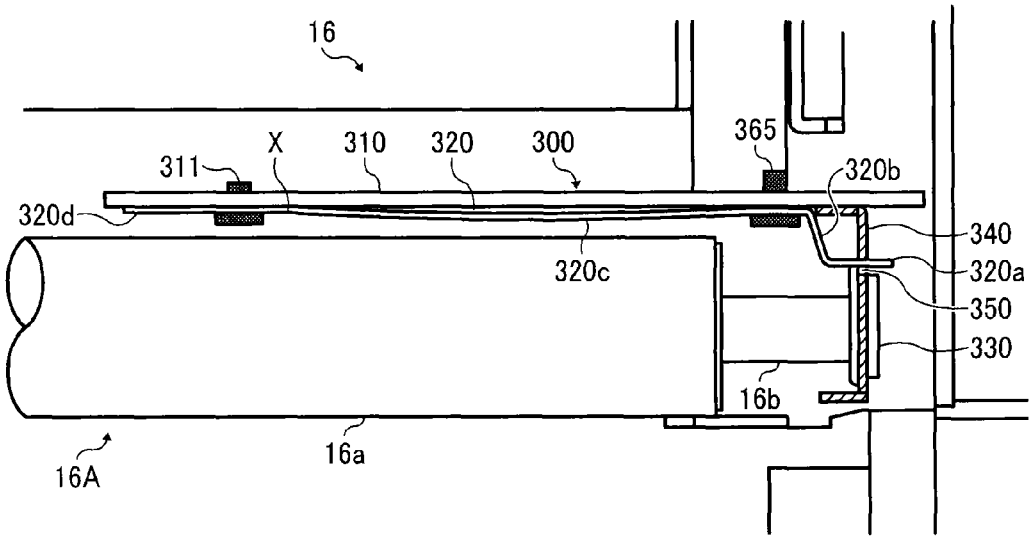
FIG. 16 is a side view of a pressing roller unit according another example of this disclosure, illustrating an upper roller of an output roller pair unit of FIG. 1 and parts near the upper roller.

FIG. 16 is a side view of another pressing roller unit 300 according another example of this disclosure, illustrating an upper roller 16A of the output roller pair unit 16 of FIG. 1 and parts near the upper roller 16A.

The pressing roller unit 300 that functions as a recording medium conveyor includes the upper roller 16A, the bearing guides 340, a frame 310, and a pressing member 320.

The pressing roller unit 300 is secured to the apparatus body 200 by screws and is included in the output roller pair unit 16. The upper roller 16A includes a roller cover 16*a* and a rotary shaft 16*b*. The roller cover 16*a* is arranged extending in the longitudinal direction (the axial direction) of the upper roller 16A to cross the recording medium conveying direction of the recording medium P to hold and convey the recording medium P. The rotary shaft 16*b* projects from an end surface of the roller cover 16*a* in the longitudinal direction of the upper roller 16A. The rotary shaft 16*b* is formed of metal such as iron. The roller cover 16*a* is formed of an elastic member such as sponge and covers around the rotary shaft 16*b*. The upper roller 16A is pressed downwardly in FIG. 16 by the pressing member 320 that extends in the same direction as the longitudinal direction of the upper roller 16A. The pressing member 320 is a flat metallic leaf spring having multiple bends. By arranging the pressing member 320 along the longitudinal direction of the upper roller 16A, the image forming apparatus 100 can reduce the size in the recording medium conveying direction and the vertical direction thereof and variation in the pressing force can be reduced due to a sufficient length of the pressing member 320.

Figure 18A:
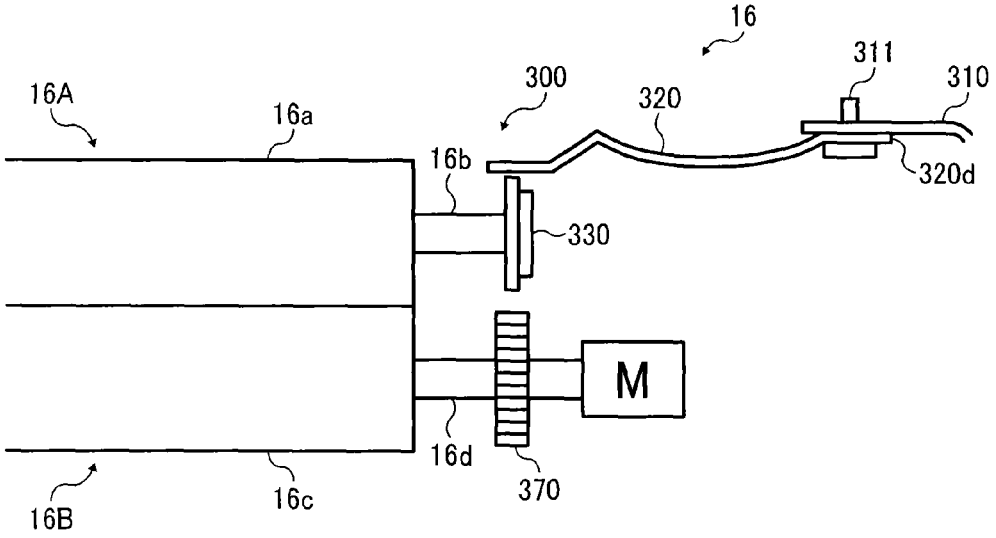
FIG. 18A is a side view illustrating a configuration of the pressing roller unit according to another example of this disclosure.

FIG. 16 shows a state in which the recording medium P is conveyed by the upper roller 16A that is a driven roller and a lower roller 16B that is a driving roller (see FIG. 18A). That is, in FIG. 16, the upper roller 16A is pressed upwardly by the recording medium P and is located at a pressed position. The upper roller 16A is pressed downwardly by the pressing member 320, and therefore, when the recording medium P comes to a nip formed between the upper roller 16A and the lower roller 16B, the recording medium P is pressed firmly and conveyed by the upper roller 16A and the lower roller 16B. It is to be noted that the lower roller 16B that receives a force transmitted by a drive source is fixed, and therefore cannot move vertically. Further, even when the recording medium P is not held at the nip between the upper roller 16A and the lower roller 16B, the upper roller 16A is pressed downwardly by the pressing member 320 with a weaker force in assembly of the pressing roller unit 300.

In FIG. 16, a fixing part 320*d* is provided at one end of the pressing member 320 and an action part 320*b* is provided at the other end or an opposed end of the pressing member 320. The fixing part 320*d* is secured to the frame 310 of the pressing roller unit 300 by screws 311. The action part 320*b* directly or indirectly presses the rotary shaft 16*b* downwardly. In the present example, an edge 320*a* of the action part 320*b* is inserted through the cut 350 (either of the cuts 350*a* and 350*b*) formed on each bearing guide 340 that is secured to the frame 310 by each screw 365, and presses each bearing 330 attached to both ends of the rotary shaft 16*b*.

The pressing member 320 further includes an arm 320*c* disposed between the fixing part 320*d* and the action part 320*b*. The arm 320*c* is warped downwardly from the fixing part 320*d* toward the roller cover 16*a* in FIG. 16.

The fixing part 320*d* of the pressing member 320 is disposed facing the roller cover 16*a* and inside the frame 310. With this configuration, the pressing member 320 can be provided in excess space formed above the roller cover 16*a*, thereby preventing an increase of the image forming apparatus 100 in the vertical direction.

Figure 17:
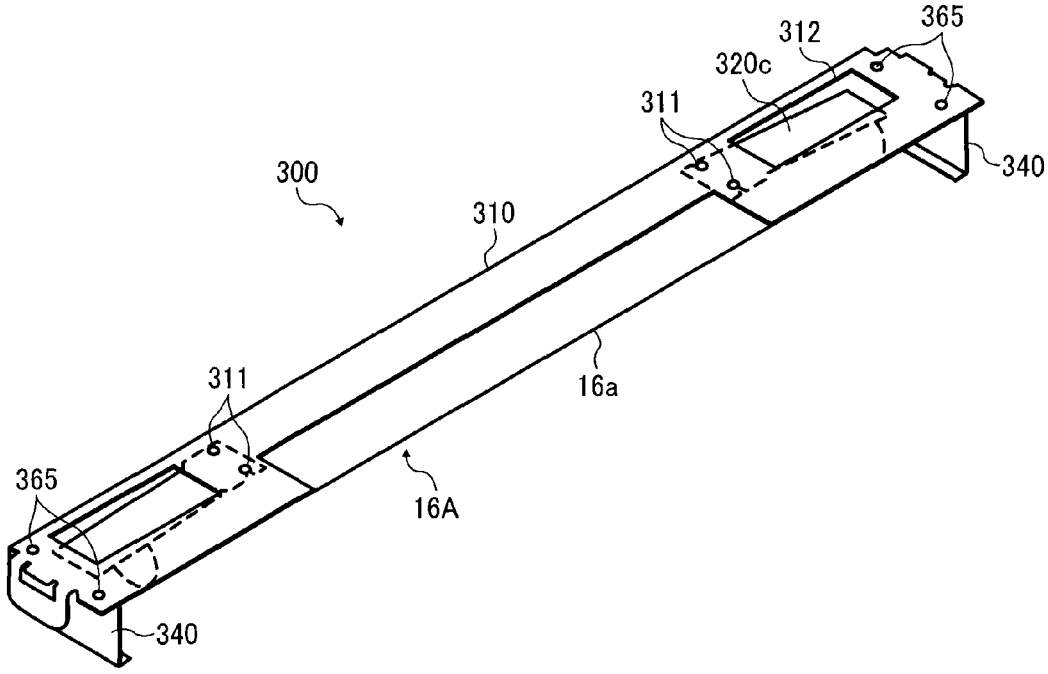
FIG. 17 is a perspective view of a pressing roller unit.

FIG. 17 is a perspective view of the pressing roller unit 300.

The bearing 330 of the upper roller 16A is inserted through the cut 350 of each bearing guide 340. The upper roller 16A and the bearing guides 340 are secured by the screws 365 to the frame 310. The pressing member 320 is secured to the frame 310 by the screws 311 from inside the frame 310. Alternative to the screws 311, the pressing member 320 can be welded to the frame 310. In FIG. 17, the bearing 330 of the upper roller 16A is not showing. An entry path 312 is formed on the frame 310. The entry path 312 is formed to function as an opening so that the arm 320*c* of the pressing member 320 can move by passing therethrough. As the recording medium P enters between the upper roller 16A and the lower roller 16B, the end of the arm 320*c* rises. By forming the entry path 312, the frame 310 to which the fixing part 320*d* is fixed and the arm 320*c* do not interfere with each other. Rise of the end of the arm 320*c* will be described below.

Figure 18B:
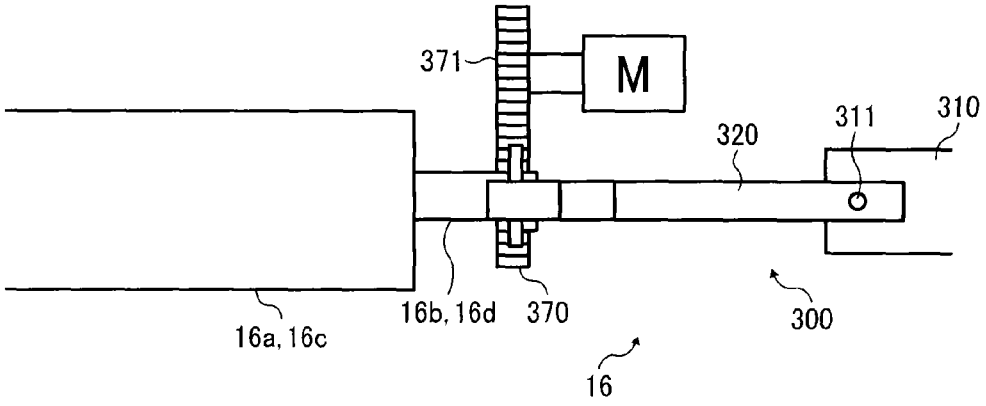
FIG. 18B is a plane view illustrating the configuration of the pressing roller unit of FIG. 18A.

FIG. 18A is a side view illustrating a configuration of another pressing roller unit 300 according to another example of this disclosure, including another pressing member 320. FIG. 18B is a plane view illustrating the configuration of the pressing roller unit 300 of FIG. 18A.

As illustrated in FIG. 18A, the fixing part 320*d* of the pressing member 320 is secured by the screw 311 to the frame 310 at a position outside from the end of the rotary shaft 16*b* in the longitudinal direction of the upper roller 16A (i.e., the right side of the drawing), so that the pressing member 320 extends from the fixing part 320*d* toward the bearing 330. In this case, the output roller pair unit 16 includes the upper roller 16A and the lower roller 16B. The upper roller 16A includes the roller cover 16*a* and the rotary shaft 16*b*. The lower roller 16B includes the roller cover 16*c* and the rotary shaft 16*d*. Here, the lower roller 16B functions as a driving roller and the upper roller 16A functions as a driven roller. Specifically, a gear 370 is mounted on the rotary shaft 16*d* of the lower roller 16B and is meshed with a gear 371 of a motor M. Consequently, as illustrated in FIG. 18B, there is the excess space outside from the end of the rotary shaft 16*b* in the longitudinal direction of the upper roller 16A, and therefore the pressing member 320 can be disposed in the excess space. By so doing, an increase in size of the image forming apparatus 100 in the vertical direction can be restrained or prevented.

Figure 19A:
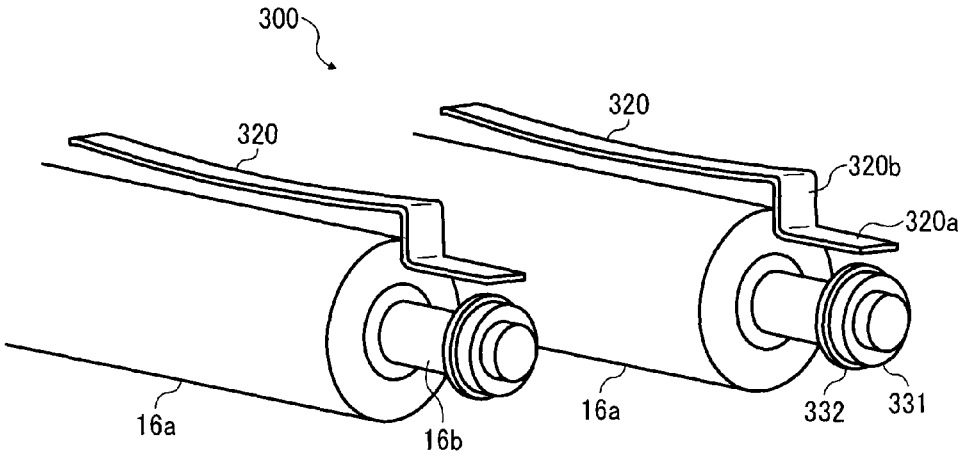
FIG. 19A is a perspective view of a part of the pressing roller unit according to yet another example of this disclosure.
Figure 19B:
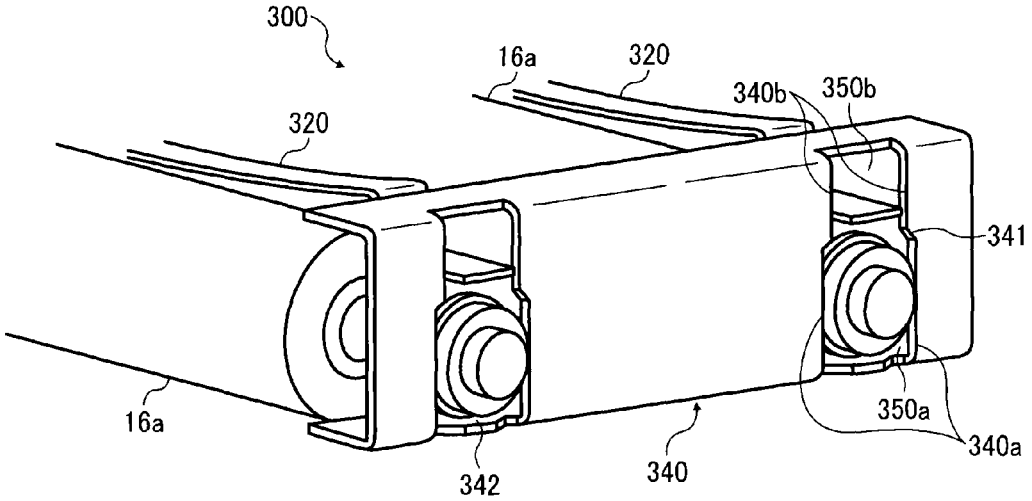
FIG. 19B is a perspective view of a part of the pressing roller unit of FIG. 19A with a bearing guide.

FIG. 19A is a perspective view of a part of another pressing roller unit 300 according to yet another example of this disclosure. FIG. 19B is a perspective view of a part of the pressing roller unit 300 of FIG. 19A with one of the bearing guides 340.

Different from the pressing roller unit 300 including one roller cover 16*a* as illustrated in FIG. 17, the pressing roller unit 300 according to the present example includes two roller covers 16*a*, four pressing members 320, a frame, four bearings 330, and two bearing guides 340. The four pressing members 320 are pressed by the two roller covers 16*a*. The four bearings 330 and the two bearing guides 340 are mounted on the rotary shaft 16*b*. However, in FIG. 19, the frame and the bearing guides 340 are not illustrated in FIG. 19A. In FIG. 19B, the pressing member 320, the roller cover 16*a*, and the bearing guides 340 are illustrated. The pressing roller unit 300 has the identical configurations at one end and the other end, i.e., the opposed end. Therefore, FIGS. 19A and 19B show the one end of the pressing roller unit 300, omitting the configuration at the other end.

The pressing member 320 includes the fixing part 320*d* at one longitudinal end of the roller cover 16*a* and the action part 320*b* at the other end or the opposed end of the roller cover 16*a* to insert the rotary shaft 16*b* via the bearing 330. The bearing 330 includes the cylindrical part 331 and the flange 332. The cylindrical part 331 is arranged on the outer side of the axial direction of the pressing member 320. The flange 332 is arranged on the inner side of the axial direction of the pressing member 320 and extends toward the outer side of a radial direction of the pressing member 320 than the cylindrical part 331. As illustrated in FIG. 18B, each of the bearing guides 340 is formed of a flat metal sheet bent to a nearly U-shaped cross section. Each of the bearing guides 340 includes a guide pair 340*a* and a guide pair 340*b* each of which extends substantially parallel in a pressing direction (the vertical direction) of the output roller pair unit 16. The guide pair 340*a* and the guide pair 340*b* are joined to each other at the step 341. The width of the cut 350*a* is formed greater than the width of the cut 350*b*. Respective widths of the cuts 350*a* and 350*b* in the recording medium conveying direction are defined by the guide pairs 340*a* and 340*b* of the bearing guide 340, respectively.

Figure 20:
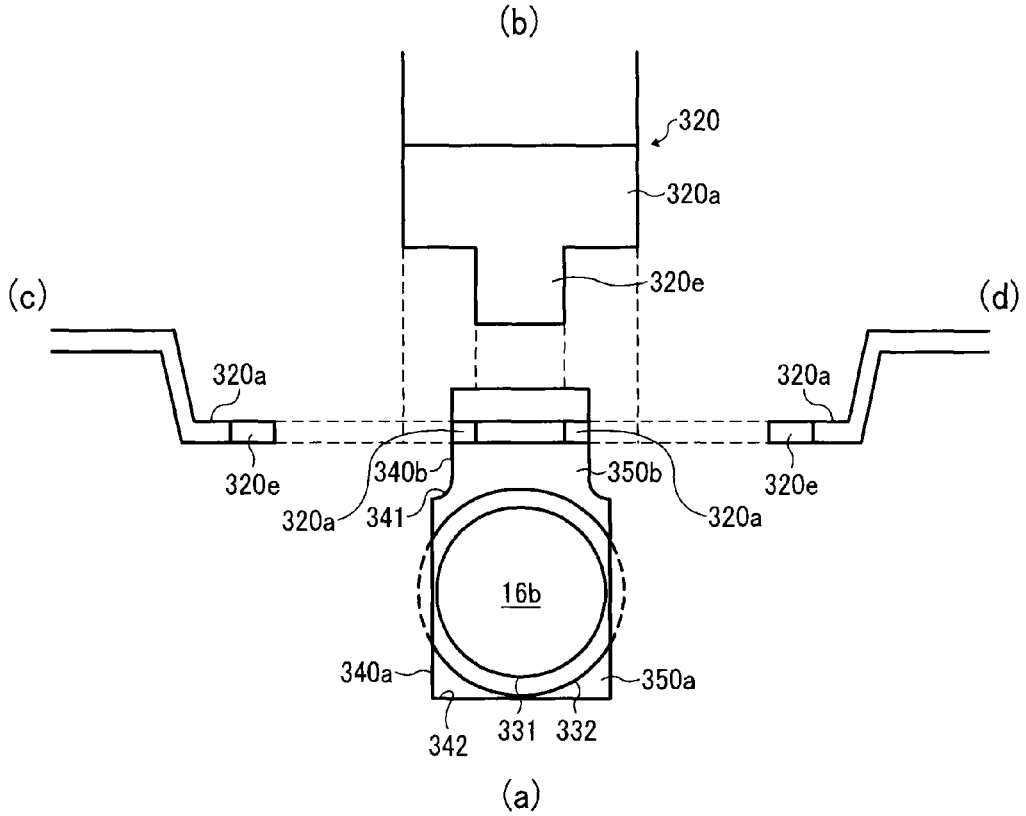
FIG. 20 is a front view of a bearing and a pressing part viewed from outside in an axial direction.

FIG. 20 illustrates the bearing 330 and the pressing member 320. The diagram (a) of FIG. 20 is a front view of the pressing member 320, the diagram (b) of FIG. 20 is a left side view of the pressing member 320, the diagram (c) of FIG. 20 is a right view of the pressing member 320, and the diagram (d) of FIG. 20 is a top view of the pressing member 320. In the diagrams (a), (b), (c), and (d) of FIG. 20, the pressing member 320 is a variation of the pressing member 320 of FIGS. 19A and 19B. Further, the pressing member does not contact the bearing 330. However, the pressing member 320 contacts the flange 332 by a spring force in assembly of the pressing roller unit 300.

As illustrated in FIG. 20, the width of the cut 350*a* defined by the guide pair 340*a* is smaller than the diameter of the flange 332 and is greater than the diameter of the cylindrical part 331. The cylindrical part 331 is projected outwardly in the axial direction of the pressing member 320 through the cut 350*a* defined by the guide pair 340*a*. By contrast, the cut 350*b* defined by the guide pair 340*b* located upper than the step 341 is smaller than the diameter of the cylindrical part 331. Consequently, the bearing 330 is guided by the guide pair 340*a* and can move vertically in the cut 350*a* while movement of the cylindrical part 331 upper than the step 341 is restricted by the step 341. With this configuration, even if the fixing part 320*d* of the pressing member 320 faces the roller cover 16*a* and the head of the screw 311 projects toward the roller cover 16*a* as illustrated in FIG. 16, the elevated roller cover 16*a* does not contact the head of the screw 311.

Further, in FIG. 16, the screw 311 is not disposed directly above the center of the rotary shaft 16*b* and is shifted from the axial center of the rotary shaft 16*b* to the front or back of the drawing. Therefore, the contact of the roller cover 16*a* and the head of the screw 311 can be avoided reliably.

It is to be noted that the pressing member 320 can be secured to the frame 310 by stop welding instead of the screw 311. Since a welding part does not project toward the roller cover 16*a*, when spot welding is performed at one point, the welding part is preferably located directly above the center of the rotary shaft 16*b*. By so doing, the pressing force from the pressing member 320 to the upper roller 16A with the welding part as a fulcrum can be applied uniformly, and therefore a load on the pressing member 320 can be reduced.

As illustrated in FIGS. 19B and 20, the flange 332 having the diameter greater than the width of the cut 350*a* is disposed inside the axial direction of the bearing guides 340. Since each roller includes the bearing 330 at each end thereof, movement of each roller in the axial direction is restricted.

Further, a lower part of the flange 332 contacts the bottom face 342 of each bearing guide 340, and therefore movement of each bearing 330 in the downward direction is restricted.

Here, the edge 320*a* of the pressing member 320 has a contact portion 320*e* that is shorter or smaller than the width of the cut 350*b* defined by the guide pair 340*b*. The contact portion 320*e* projects outside in the axial direction of the pressing member 320 passing through the cut 350*b*, so that the contact portion 320*e* can contact an outer circumferential surface of the flange 332. Further, the width of the pressing member 320 is greater than the width of the cut 350*a*. Since the pressing force (the spring constant) of the pressing member 320 is determined based on the width and the thickness of the cut 350*a*, the width of the pressing member 320 is set greater than the width of the cut 350*a* in order to obtain the pressing force to press the roller cover 16*a* in the present example. Therefore, once the desired pressing force is obtained, the width of the pressing member 320 may be smaller than the width of the cut 350*a*.

Figure 21A:
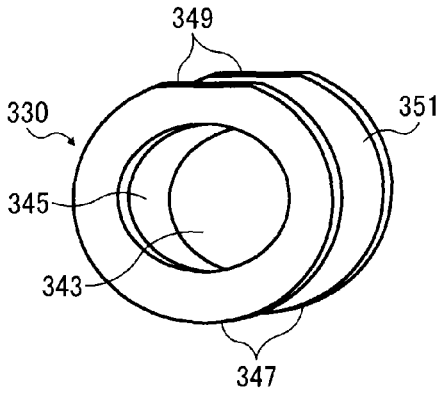
FIG. 21A is a perspective view of the bearing according to a variation of the example of this disclosure.
Figure 21B:
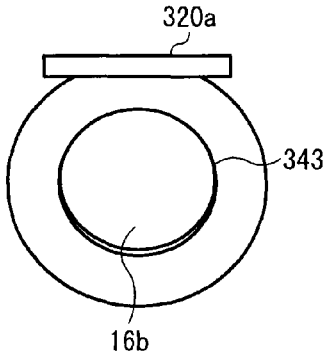
FIG. 21B is a front view of the bearing of FIG. 21A.

FIG. 21A is a perspective view of the bearing according to a variation of the example of this disclosure. FIG. 21B is a front view of the bearing of FIG. 21A.

As illustrated in FIG. 21A, the bearing 330 includes a cylindrical part 345 and two flanges 347. The cylindrical part 345 has a round opening 343 and the flanges 347 are formed on both ends of the cylindrical part 345. Part of an outer circumferential surface of the flange 347 forms a flat surface 349. A recess 351 is formed between the two flanges 347.

As illustrated in FIG. 21B, the opening 345 can receive the rotary shaft 16*b* to be inserted therethrough. The rotary shaft 16*b* can be rotated relative to the bearing 330. In assembly of the pressing roller unit 300, the flat surface 349 functions as a receiving face to receive the edge 320*a* of the pressing member 320. The guide pair 340*a* illustrated in FIG. 19B is attached and hold the bearing 330 in the recess 351. The bearing 330 is guided vertically by the two flanges 347. When the cylindrical part 345 contacts the step 341 (see FIG. 19B), further upward movement of the cylindrical part 345 is restricted. With this configuration, this regulating position regulated by the step 341 is the highest portion of the bearing 330 regulating position.

When the edge 320*a* of the pressing member 320 presses the rotary shaft 16*b* directly, the edge 320*a* and the outer circumferential surface of the rotary shaft 16*b*, and therefore the contact of the edge 320*a* contacts the outer circumferential surface of the rotary shaft 16*b* with a point contact unstably. By providing the bearing 330 having the configuration as illustrated in FIGS. 21A and 21B, the flat surface 349 contacts the edge 320*a* reliably. Therefore, the roller can be inserted into the bearing 330 more reliably.

Figure 22A:
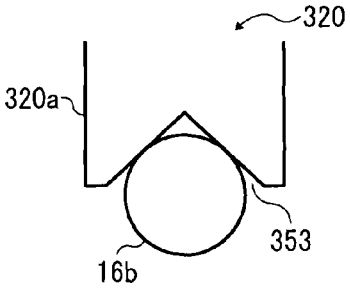
FIG. 22A is a schematic view of the pressing member and the rotary shaft according to another example of this disclosure, viewed from outside in the axial direction according to another example of the pressing member.
Figure 22B:
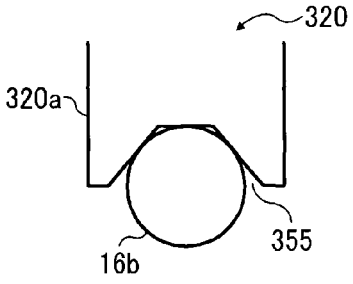
FIG. 22B is a schematic view of the pressing member and the rotary shaft according to yet another example of this disclosure, viewed from outside in the axial direction according to another example of the pressing member.
Figure 22C:
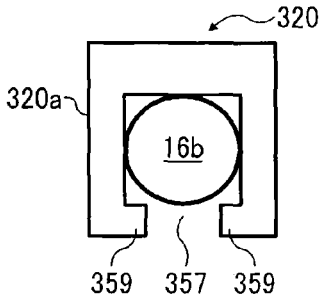
FIG. 22C is a schematic view of the pressing member and the rotary shaft according to yet another example of this disclosure, viewed from outside in the axial direction according to another example of the pressing member.

FIG. 22A is a schematic view of the pressing member 320 and the rotary shaft 16*b* according to another example of this disclosure, viewed from outside in the axial direction of the rotary shaft 16*b*. FIG. 22B is a schematic view of the pressing member 320 and the rotary shaft 16*b* according to yet another example of this disclosure, viewed from outside in the axial direction of the rotary shaft 16*b*. FIG. 22C is a schematic view of the pressing member 320 and the rotary shaft 16*b* according to yet another example of this disclosure, viewed from outside in the axial direction of the rotary shaft 16*b*.

As described above, the edge 320*a* of the pressing member 320 may press the rotary shaft 16*b* directly. However, the flat edge 320*a* contacts the outer circumferential surface of the rotary shaft 16*b* with a point contact, and therefore the contact of the edge 320*a* and the rotary shaft 16*b* are unstable. In order to address the inconvenience, the bearing 330 and the bearing guide 340 are used in the configuration illustrated in FIGS. 19A and 19B to stabilize the roller 16 and the pressing member 320.

In the present example, a cut is formed on the flat edge 320*a* of the pressing member 320, so that the outer circumferential surface of the rotary shaft 16*b* contacts inner sides of the cut at two point (FIG. 22A) or three points (FIG. 22B). By so doing, the pressing member 320 can directly press the rotary shaft 16*b* or the bearing 330 reliably. A trilateral cut 353 is formed on the flat edge 320*a* in FIG. 22A and a quadrilateral cut 355 is formed on the flat edge 320*a* in FIG. 22B. Different from the configuration illustrated in FIG. 19A, the edge 320*a* of the present example does not extend in substantially parallel to the arm 320*c*. Specifically, the edge 320*a* of the present example ends at a bend formed at the action part 320*b*. Consequently, the edge 320*a* extends to the rotary shaft 16*b* at a substantially right angle. Alternatively, the edge 320*a* contacts the rotary shaft 16*b* at a substantially right angle when the recording medium P enters between the rollers such as rollers 16A and/or 16B. As a result, the pressing force applied by the pressing member 320 is transmitted to the rotary shaft 16*b* without any loss of the pressing force.

In FIG. 22C, the edge 320*a* of the pressing member 320 has a cut 357 that is formed to substantially surround the rotary shaft 16*b*. Regulators 359 are formed to roll inwards toward the axial center of the rotary shaft 16*b*. The rotary shaft 16*b* is inserted into the cut 357. In this case, the edge 320*a* surrounds the rotary shaft 16*b* from top and both lateral sides (i.e., left and right). Even through part of the edge 320*a* of FIG. 22C is open, a gap formed between the regulators 359 is smaller than a diameter of the rotary shaft 16*b*, and therefore the rotary shaft 16*b* does not come out from the pressing member 320. As a result, even though the bearing guide 340 is not provided, the output roller pair unit 16 can be held without falling in the recording medium conveying direction.

Figure 23:
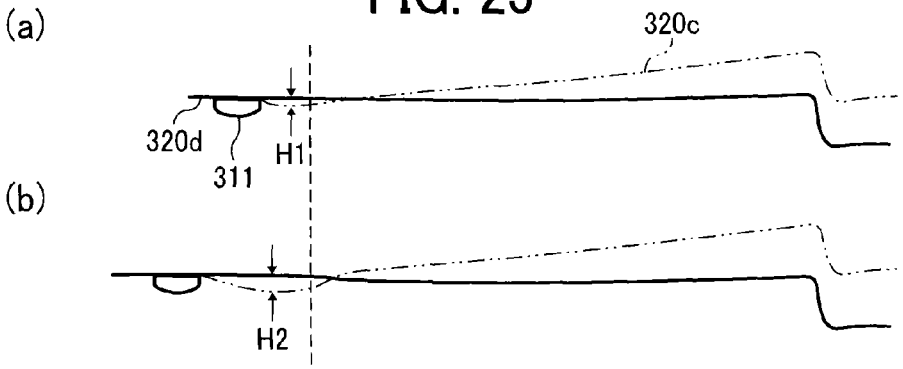
FIG. 23 illustrates a relation of a distance of an arm and a fixing part of the pressing member.

FIG. 23 illustrates a relation of a distance of the arm 320*c* and the fixing part 320*d* of the pressing member 320.

A solid line indicates a position of the pressing member 320 to which a large force is not applied and a dotted line indicates another position of the pressing member to which a large force is applied.

The arm 320*c* is bent at a bending position indicated by the dotted line from the fixing part 320*d* toward the roller cover 16*a*. In a diagram (a) of FIG. 23, a fixing position of the fixing part 320*d* with the screw 311 to the bending position of the arm 320*c* is relatively short. In a diagram (b) of FIG. 23, the fixing position of the fixing part 320*d* with the screw 311 to the bending position of the arm 320*c* is relatively long. As illustrated by arrows in the diagram (b) of FIG. 23, if the distance from the fixed position to the bending position is long, a part of the arm 320*c* from the fixing position to the bending position expands downwardly (H2>H1). Consequently, it is unlikely that a desired pressing force is obtained at the edge 320*a*. Therefore, it is preferable that the distance from the fixing position to the bending position is relatively short.

Figure 24A:
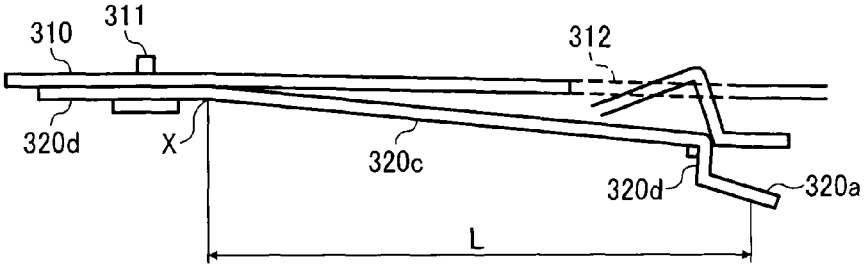
FIGS. 24A and 24B are side views of the pressing member.
Figure 24B:
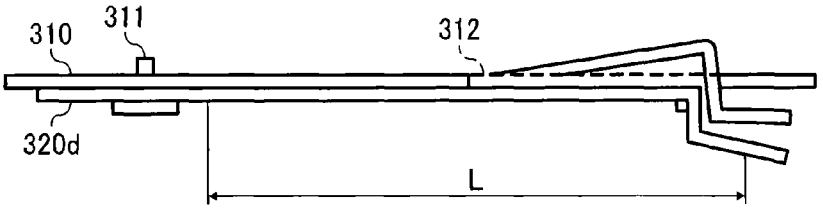

FIGS. 24A and 24B are side views of the pressing member 320.

In FIG. 24A, the pressing member 320 is bent toward a rotary body (e.g., the rotary shaft 16*b*) at a bending position X from the fixing part 320*d* at one end thereof and the arm 320*c* extends from the bending position X. The arm 320*c* is bent at a substantially right angle at the action part 320*b* at the opposed end of the pressing member 320 and the action part 320*b* has the edge 320*a* that is bent at an obtuse angle. The pressing member 320 can be belt at a right angle highly precisely but cannot be belt at an obtuse angle as precise as the bend at a right angle. For this reason, one of the two bends is bent at a substantially right angle.

When the recording medium P enters between the upper roller 16A and the lower roller 16B, the pressing member 320 is pressed by the bearing 330 to be located at a pressing position illustrated in FIG. 24A and part of the pressing member 320 enters the entry path 312. The entry path 312 may be any size as long as the pressing member 320 does not contact the entry path 312. When the recording medium P enters between the upper roller 16A and the lower roller 16B, the edge 320*a* of the action part 320*b* is designed to substantially horizontal. By providing the edge 320*a* to be substantially horizontal, the bearing 330 can be pressed in a downward direction efficiently. The pressing member 320 extends in the axial direction of the roller and a distance indicated by reference numeral L is sufficiently large. Therefore, a spring constant "k" becomes smaller and variation of the pressing force of the pressing member 320 becomes smaller.

The configuration of FIG. 24B is different from the configuration of the FIG. 24A in that the pressing member 320 is not bent at the bending position X but extends linearly. In this case, when the recording medium P enters between the rollers of the output roller pair unit 300, part of the pressing member 320 enters the entry path 312 formed by the frame 310 and the entrance height of the pressing member 320 is higher than the entrance height of the pressing member 320 in FIG. 24A. In addition, the entrance width of the pressing member 320 is also greater than the entrance width of the pressing member 320 in FIG. 24A, and therefore a relatively large entry path 312 is formed. Consequently, from a viewpoint of flexibility in the installation of the pressing member 320 in the excess space above the frame 310 and strength of the frame 310 caused by the size of the entry path 312, the pressing member 320 having the configuration of FIG. 24A is preferable. However, since the pressing member 320 having the configuration of FIG. 24B has a sufficiently large distance L, the spring constant k is reduced, and therefore variation of the pressing force of the pressing member 320 is also reduced.

Referring to FIG. 16, the arm 320*c* is bent from the fixing part 320*d* (or the bending position X) toward the roller cover 16*a* and the action part 320*b* is bent at a substantially right angle from the arm 320*c*. Here, the action part 320*b* functions as a retracting part to avoid contact with the upper roller 16A. The retracting part is effective to avoid contact of the arm 320*c* and the upper roller 16*a* in a case in which the action part 320*b* is not bent and the arm 320*c* bent from the fixing part 320*d* extends linearly to the edge 320*a*.

Figure 25:
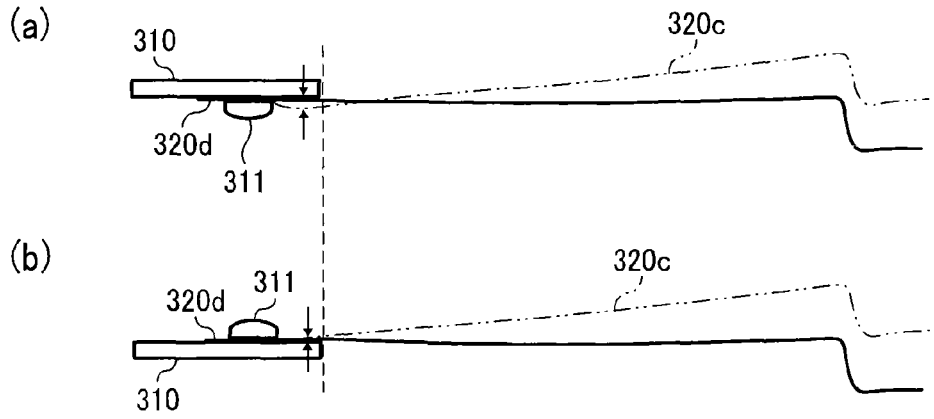
FIG. 25 is a schematic diagram illustrating the pressing member.

FIG. 25 illustrates a schematic diagram of the pressing member 320. A diagram (a) of FIG. 25 shows a case in which the fixing part 320*d* is mounted on a lower side of the frame 310, which is a side facing the upper roller 16A. A diagram (b) of FIG. 25 shows a case in which the fixing part 320*d* is mounted on an upper side of the frame 310.

As illustrated in the diagram (a) of FIG. 25, if the fixing part 320*d* is mounted on the lower side of the frame 310, which is the side facing the upper roller 16A, the pressing member 320 receives a downward force with respect to a right end position of the frame 310 as a fulcrum. Consequently, a linear force is applied over the entire width of the frame 310 in a vertical direction on the drawing.

By contrast, as illustrated in the diagram (b) of FIG. 25, if the fixing part 320*d* is mounted on the upper side of the frame 310, the pressing member 320 receives an upward force with respect to the screw 311 as a fulcrum. Consequently, a local force is applied in the vicinity of the screw 311, and therefore the pressing member 320 can cause fatigue easily. Therefore, it is preferable that the fixing part 320*d* of the pressing member 320 is mounted on the side of the frame 310 facing the output roller pair unit 16.

However, the fixing pat 320*d* may be mounted on the upper side of the frame 310 as described below.

Figure 26:
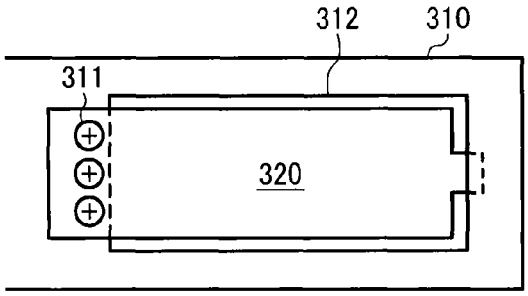
FIG. 26 is a plane view of a frame in a case in which a fixing part is provided on an upper side of the frame.
Figure 27:
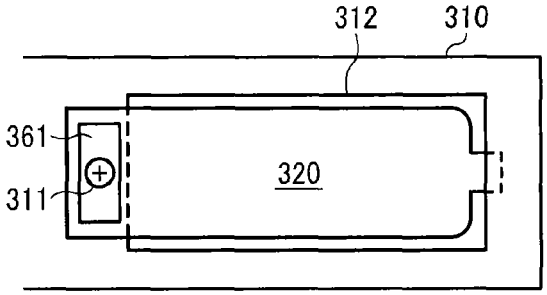
FIG. 27 is a plane view of the frame in a case in which the fixing part is provided on the upper side of the frame.
Figure 28:
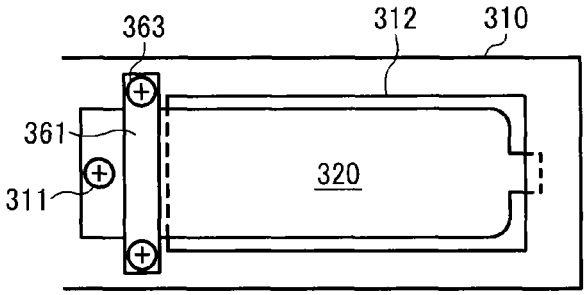
FIG. 28 is a plane view of the frame in a case in which the fixing part is provided on the upper side of the frame.

FIG. 26 is a plane view of the frame 310 in a case in which the fixing part 320*d* is provided the upper side of the frame 310. FIG. 27 is a plane view of the frame 310 in a case in which the fixing part 320*d* is provided on the upper side of the frame 310. FIG. 28 is a plane view of the frame 310 in a case in which the fixing part 320*d* is provided on the upper side of the frame 310.

In FIG. 26, the fixing part 320*d* of the pressing member 320 is secured on the upper side of the frame 310 with the three screws 311. The three screws 311 are aligned across the width of the frame 310, and therefore the pressing force applied to the pressing member 320 is dispersed to three portions.

In FIG. 27, a rectangular member 361 is placed on the pressing member 320. On the rectangular member 361, the fixing part 320*d* of the pressing member 320 is secured on the upper side of the frame 310 with one screw 311.

In FIG. 28, the fixing part 320*d* of the pressing member 320 is secured on the upper side of the frame 310. Further, the rectangular member 361 is placed on the fixing part 320*d* and both ends of the rectangular member 361 are secured to the frame 310 with screws 363. Since the right side of the rectangular member 361 extends in the width direction of the frame 310, not a local force but a linear force is applied to the pressing member 320.

The above-described configurations can also be applied to the lower roller 16B of the output roller pair unit 16. When applying to the lower roller 16B, the pressing roller unit 300 of FIG. 19B is turned upside down, for example. The upside-down pressing roller unit 300 can press the upper roller 16A of the output roller pair unit 16.

Further, the above-described pressing unit can be applied to the upper roller 16A and the lower roller 16B conveying the recording medium. Specifically, the cooling device may be disposed on the upper side and the lower side of the recording medium P conveyed by the rotary body of the recording medium conveyor and the pressing member. However, when the pressing unit is applied to the lower roller (e.g., the lower roller 16B), the pressing member 320 supports the weight of the lower roller. If the upper roller 16A and the lower roller 16B employ the identical pressing member 320, the pressing force of the lower roller 16B is smaller than the pressing force of the upper roller 16A. It is because the pressing member 320 of the lower roller 16B receives the weight of the lower roller 16B that presses the lower roller 16B downwardly. Therefore, it is preferable that either one of a width and a thickness of the pressing member 320 disposed on the lower side of the frame 310 is greater than either one of a width of a thickness of the pressing member 320 disposed on the upper side of the frame 310. By changing the condition of the pressing member 320, the frame 310 can be shared, and therefore the cost of the pressing roller unit 300.

Figure 29:
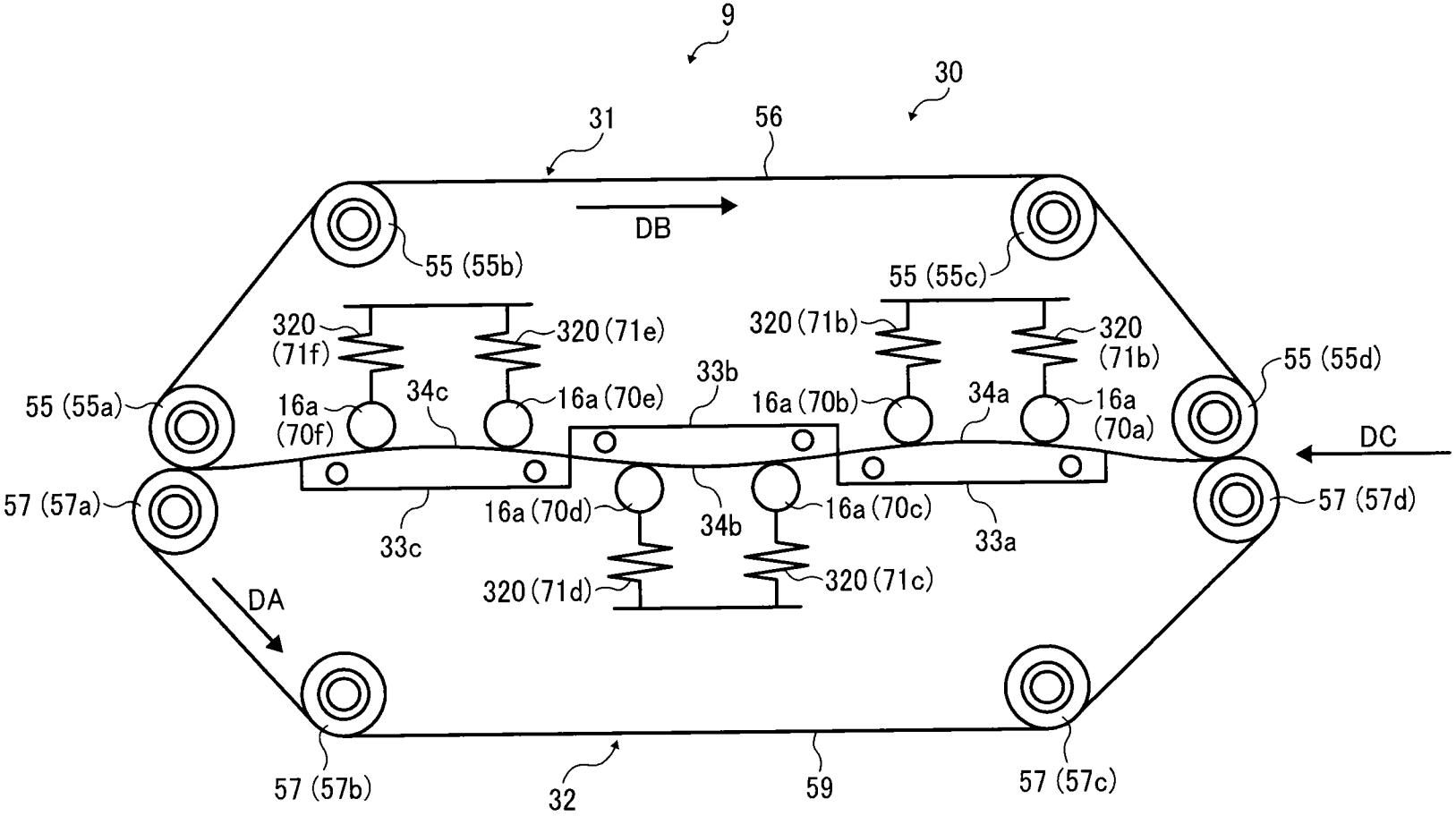
FIG. 29 is a schematic diagram illustrating the pressing roller unit applied to the cooling device.

FIG. 29 is a schematic diagram illustrating the pressing roller unit applied to the recording medium cooling device 9.

It is to be noted that the upper roller 16A and the lower roller 16B both having the roller covers 16*a* as illustrated in FIG. 29 can be applied to the pressing rollers 70*a* through 70*f* illustrated in FIG. 11A. Further, it is also to be noted that the pressing members 320 illustrated in FIG. 29 can be applied to the biasing members 71*a* through 71*f* illustrated in FIG. 11A.

As illustrated in FIG. 29, the cooling device 9 includes the cooling members 33*a*, 33*b*, and 33*c* to cool the recording medium P that is conveyed in the conveyance path. The roller cover 16*a* of the pressing roller unit 300 is disposed facing the absorbing surfaces 34*a*, 34*b*, and 34*c* of the respective cooling members 33*a*, 33*b*, and 33*c*. The roller cover 16*a* presses and conveys the recording medium P indirectly via the belts 56 and 59. In this case, one pressing roller unit 300 illustrated in FIG. 19 can be used to each of the cooling members 33*a*, 33*b*, and 33*c* or two pressing roller units 300 illustrated in FIG. 17 can be used to each of the cooling members 33*a*, 33*b*, and 33*c*.

Further, the above-described pressing unit can be applied to the upper roller and the lower roller conveying the recording medium. Specifically, the cooling device may be disposed on the upper side and the lower side of the recording medium P conveyed by the rotary body of the recording medium conveyor and the pressing member. However, when the pressing unit is applied to the lower roller (e.g., the lower roller 16B), the pressing member 320 supports the weight of the lower roller. If the upper roller 16A and the lower roller 16B employ the identical pressing member 320, the pressing force of the lower roller 16B is smaller than the pressing force of the upper roller 16A. It is because the pressing member 320 of the lower roller 16B receives the weight of the lower roller 16B that presses the lower roller 16B downwardly. Therefore, it is preferable that either one of a width and a thickness of the pressing member 320 disposed on the lower side of the frame 310 is greater than either one of a width of a thickness of the pressing member 320 disposed on the upper side of the frame 310. By changing the condition of the pressing member 320, the frame 310 can be shared, and therefore the cost of the pressing roller unit 300.

When the above described pressing roller unit 300 is applied to the pressing roller 320 provided to the pressing rollers 70*a* and 70*b* illustrated in FIG. 11A, the width or the thickness of the pressing member mounted on the pressing rollers 70*a* and 70*b* can be made smaller than the width or the thickness of the pressing rollers 70*e* and 70*f*.

Further, the number of the cooling members is not limited to the configurations shown in FIGS. 1 through 3 and 11A through 13. For example, the number of the cooling members may be one or two.

Further, the cooling member at the extreme upstream side in the recording medium conveying direction is not limited to be located at a lower side but can be located at an upper side. In this case, instead of or in addition to the position as illustrated in FIGS. 13 and 15A, the tension member may be disposed between the roller 57*d* and the pressing roller 70*a*, upstream from the cooling member 33*a* in the recording medium conveying direction, and in contact with the belt 59, as illustrated in FIG. 15B. In this case, the tension member is pressed upward by the eccentric cam unit and/or the biasing members, so that the belt 59 can be moved toward the belt 56.

Further, the absorbing surface of the cooling member is not limited to an arc surface shape. For example, a flat surface can be applied to the absorbing surface of the cooling member of this disclosure.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A cooling device, comprising:

a conveyor to convey a recording medium with a first belt and a second belt each of which is in a loop, the first belt wound around a first end roller which is disposed at an end of the first belt facing a plane of a conveyance path;

a cooler within the loop of the second belt and cooling the recording medium discharged from a fixing device; and a roller within the loop of the first belt and between the first end roller and the cooler, the roller contacting the first belt toward the conveyance path such that the conveyance path gradually widens along an upstream direction from a position where the roller contacts the first belt, wherein the roller is disposed such that the first belt does not contact the second belt at the position where the roller contacts the first belt.

2. The cooling device according to claim 1, further comprising a second end roller around which the second belt is wound, and the second end roller disposed upstream from the cooler in a direction of movement of the second belt; and a guide to guide the recording medium to the conveyance path between the first end roller and the second end roller.

3. The cooling device according to claim 2, wherein the guide is disposed such that a downstream edge thereof passes between the roller and the first end roller.

4. The cooling device according to claim 2, wherein the guide comprises an upper guide with a downstream edge facing the second belt; and a lower guide with a downstream edge facing the upper guide and disposed upstream from the downstream edge of the upper guide.

5. The cooling device according to claim 1, wherein the roller moves to change a recording medium holding region of the first belt and the second belt in a downstream direction.

6. The cooling device according to claim 5, further comprising an eccentric cam to press the roller.

7. The cooling device according to claim 1, further comprising a pressure roller disposed in contact with an inner circumferential surface of the first belt and pressing the cooler via the first belt and the second belt, wherein a lowest point of the roller is located at a height equal to or lower than a lowest point of the pressure roller.

8. The cooling device according to claim 1, wherein an arithmetic mean roughness of an outer circumferential surface of the first belt is at least 0.4 μm.

9. The cooling device according to claim 8, wherein an arithmetic mean roughness of an outer circumferential surface of the second belt is at least 0.1 μm.

10. An image forming apparatus comprising:

an image forming device to form an image on a recording medium; and the cooling device according to claim 8 to cool the recording medium.

11. An image forming apparatus comprising:

an image forming device to form an image on a recording medium; and the cooling device according to claim 1 to cool the recording medium.

12. A cooling device, comprising:

a conveyor to convey a recording medium in a downstream direction with a first belt and a second belt each of which is in a loop;

a cooler within the loop of the second belt and cooling the recording medium discharged from a fixing device; and rollers within the loop of the first belt and contacting an inner circumferential surface of the first belt against the cooler, an upstream roller of said rollers having a smallest pressing force of said rollers.

13. The cooling device according to claim 12, wherein the cooler includes a first cooler and a second cooler downstream from the first cooler in a downward direction, wherein the first cooler is located within the loop of the second belt in contact with an inner circumferential surface of the second belt and cooling the recording medium via the second belt, wherein the second cooler is located within the loop of the first belt in contact with the inner circumferential surface of the first belt and cooling the recording medium via the first belt, wherein a downstream roller of said rollers contacts the inner circumferential surface of the second belt and presses the second cooler with a pressing force via the first belt and the second belt, wherein the upstream roller of said rollers is located on the first cooler and presses the first cooler by an own weight thereof.

14. The cooling device according to claim 12, wherein each of the upstream roller and the downstream roller includes a shaft and a roller cover to press the cooler.

15. The cooling device according to claim 14, wherein the shaft of the upstream roller is lighter than the shaft of the downstream roller.

16. The cooling device according to claim 12, further comprising a tension roller to extend the first belt to a position upstream from the upstream roller in the recording medium conveying direction, wherein a lowest point of the upstream roller is located at a position equal to or lower than a lowest point of the tension roller.

17. The cooling device according to claim 12, further comprising a tension roller to extend the first belt to a position upstream from the upstream roller in a recording medium conveying direction; and an end roller to extend the first belt to a position upstream from the tension roller in a belt rotation direction, wherein a lowest point of the tension roller is located at a position equal to or lower than a lowest point of the upstream roller, wherein a lowest point of the end roller is upper than the lowest point of the upstream roller.

18. The cooling device according to claim 12, wherein the cooler comprises a first cooler and a second cooler disposed downstream from the first cooler in the downstream direction, wherein the first cooler contacts an inner circumferential surface of the second belt and cools the recording medium via the second belt from below a conveyance path, wherein the second cooler contacts an inner circumferential surface of the first belt and cools the recording medium via the secondi belt from above the conveyance path, wherein each of the rollers comprises a shaft projecting in a longitudinal direction thereof and a pressing member extending in the longitudinal direction of the rollers, wherein one end of the pressing member is a fixing part secured to a frame and an opposed end of the pressing member is an action part directly or indirectly presses the shaft, wherein either one of a width and a thickness of the pressing member disposed on a lower side of the frame is greater than either one of a width and a thickness of the pressing member disposed on an upper side of the frame.

19. An image forming apparatus comprising:

an image forming device to form an image on a recording medium; and the cooling device according to claim 12 to cool the recording medium.

* * * * *